US005803394A

United States Patent [19]

Kotzur et al.

[11] Patent Number: 5,803,394

[45] **Date of Patent: *Sep. 8, 1998**

[54] HIGH SPEED DUAL HEAD ON-LINE WINDING APPARATUS

[75] Inventors: Frank W. Kotzur, Carmel; Donald Woodbridge, Amenia; Thomas Rosenkranz, Dover Plains; David B. Franklin, Carmel; George Taylor Richey, Hopewell Junction, all of N.Y.

[73] Assignee: Windings, Inc., Patterson, N.Y.

[ * ] Notice: The term of this patent shall not extend beyond the expiration date of Pat. No. 5,678,778.

[21] Appl. No.: 868,947

[22] Filed: Jun. 4, 1997

Related U.S. Application Data

[62] Division of Ser. No. 409,304, Mar. 24, 1995, Pat. No. 5,678,778.

[51] Int. Cl.[6] ..... B65H 54/28; B65H 67/048

[52] U.S. Cl. ..... 242/483.8; 242/474.4

[58] Field of Search ..... 242/25 A, 43 R, 242/158.1, 474.4, 483.8

[56] References Cited

U.S. PATENT DOCUMENTS

| | | | |
|---|---|---|---|
| 1,463,181 | 7/1923 | vorderwinkler . | |
| 1,529,816 | 3/1925 | Stenglien . | |
| 2,388,557 | 11/1945 | Little et al. . | |
| 2,650,036 | 8/1953 | Berkepeis . | |
| 2,929,569 | 3/1960 | Detrick et al. | 242/25 A |
| 2,971,709 | 2/1961 | Ellis, Jr. | 242/25 A |
| 3,747,861 | 7/1973 | Wagner | 242/43 R |
| 3,877,653 | 4/1975 | Foltyn et al. | 242/25 A |
| 3,980,244 | 9/1976 | Pietroni | 242/25 A |
| 4,098,467 | 7/1978 | Engmann et al. | 242/25 A |
| 4,283,020 | 8/1981 | Bauer et al. | 242/25 A X |
| 4,637,564 | 1/1987 | Hallenbeck et al. | 242/25 A |
| 4,792,100 | 12/1988 | Pepe | 242/24 A |
| 5,678,778 | 10/1997 | Kotzur et al. | 242/25 A |

FOREIGN PATENT DOCUMENTS 532861 9/1931 Germany .

*Primary Examiner*—Michael Mansen

*Attorney, Agent, or Firm*—Watson Cole Grindle Watson, PLLC

[57] ABSTRACT

High speed traversing mechanism and method for winding filamentary material onto a rotating mandrel, wherein an indexer including a crank arm rotatable about a pivot point; a connecting rod connected to the crank arm at a second pivot point; a traverse guide connected to the connecting rod at a third pivot point located on the center line of the traverse guide and the traverse guide reciprocating within a support with rotation of the crank arm; the pivot point is positioned at a point on said center line spaced from the third pivot point; the connecting rod forming a given angle with the center line; the indexer means rotating the rotatable crank arm to displace the traverse guide along the center line within the support; and controlling the indexer to wind the filamentary material onto the mandrel.

13 Claims, 9 Drawing Sheets

4
26b
40
26a
38
22
30
36
37
28
32
30
FM
38a
20
24b
34
24a
24
58
122
25
46
120
44
88
84
86
112
118
80
124
116
64
114
72
96
66
70
68
4

304
302
BETA
SIGMA
ALPHA
C
300
312
B
306
310
308
25
44

26b
FM
30
28
22
36
34
40
FM
24
50
42
25
83
41
55
51
51a
48
57
122
56
54
84
66a
44
66
82
92
94
90
96
106
64
20
66
98
68

FM
26a
30
22
36
40
28
FM
37
34
46
50
114
48
25
114
56
52
46
74b
88
80
102b
72
104
102b
100
74a
70
78

HIGH SPEED DUAL HEAD ON-LINE WINDING APPARATUS

This application is a divisional application of application Ser. No. 08/409,304, filed 24, Mar. 1995, now U.S. Pat. No. 5,678,778.

BACKGROUND OF THE INVENTION

1. Field of the Invention

The invention relates to method and apparatus for transferring flexible filamentary (FM) material from one rotating winding mandrel to another, automatically or semi-automatically, in a high speed, dual head, On-Line winding apparatus (HSDHWA), and more particularly to such method and apparatus in which flexible FM can be wound upon one of two mandrels and the winding automatically transferred to the second of the two mandrels without interruption so as to coincide with equipment feeding FM non-stop at a substantially constant rate.

The invention also relates to method and apparatus for automatically transferring the FM from the wound mandrel to the other unwound mandrel to continue the winding of the FM on the empty mandrel, and to automatically repeat the transferring process between a wound mandrel and an unwound mandrel.

The invention further relates to a unique traverse mechanism for winding FM onto a rotating mandrel at high winding rates. The apparatus includes a means for converting pure rotating motion into a specific, circular output motion which, in turn, is converted to the desired linear output motion through the use of a crank arm, connecting rod and linearly translating carriage which carries the traverse guide for guiding the FM onto the mandrel being wound.

2. Related Art

DUAL HEAD WINDING APPARATUS

The present invention is an improvement of the method and apparatus disclosed in U.S. Pat. No. 4,477,033 assigned to the same assignee as the present invention. The disclosure of this patent pertains to a dual head on-line winding apparatus for the continuous winding of FM with first and second independently operable mandrels mounted in spaced relation in operative relation with a traverse guide for feeding the flexible FM to enable it to be alternately wound upon each of the first and second mandrels. The first and second mandrels are stacked vertically with respect to one another and the flexible FM is fed to the traverse mechanism in a direction perpendicular to the vertical axis of the stacked mandrels. The traverse reciprocation is in the same perpendicular direction. First transfer arms are mounted for movement in a vertical direction parallel to the axes of the first and second mandrels for engagement with the FM being wound thereon. Second transfer arms are mounted for horizontal movement between the first and second mandrels for engagement with the FM prior to transfer (of FM) from a wound mandrel to the free mandrel to enable continuous winding of the FM.

The speed of operation of this ON-LINE winding machine is limited by the speed of the traverse mechanism and the operation of the transfer mechanism for transferring FM from a wound mandrel to an unwound mandrel.

TRAVERSE MECHANISM

A known type of winding system uses a barrel cam traverse to distribute FM in a controlled pattern on the mandrel. The traverse mechanism consists of a barrel cam, three carriages and a swing arm and performs satisfactorily for traverse frequencies of 250 RPM or less. However, at higher RPM values the mass of the traverse mechanism components creates inertias and moments of too great a value for continuous operation, either destroying the mechanical parts, i.e. cam followers and cam surfaces, or the traverse drive motor is unable to maintain the traverse in proper synchronization with the mandrel/endform.

U.S. Pat. No. 2,650,036, as its title suggests, discloses a reciprocating block type traversing system, in which the reciprocating block is fabricated from a synthetic linear polyamide, such as nylon. In such a system the rotary motion of a driving mechanism is converted to a reciprocating motion of a traversing block which is connected to a traversing guide retaining the FM to be guided onto the mandrel.

U.S. Pat. No. 1,529,816 relates to a traverse mechanism of the crank-and-slot type using a heart-shaped driving wheel to provide a uniform movement to the thread guide.

U.S. Pat. No. 2,388,557 discloses a mechanism in an up-twister of conventional type to accelerate the rate of traverse at the end of each traverse to cause the yarn to make sharp bends as it reverses its traverse at opposite ends of the package.

U.S. Pat. No. 1,463,181 relates to a winding and reeling apparatus using a mechanism for reciprocating the thread guiding device.

German Patent No. 532,861 discloses a reciprocating thread guide mechanism driven by a heart-shaped rotating cam and follower mechanism.

It is submitted that none of the prior art traverse guide mechanisms affords satisfactory operation at high reciprocating speeds such as in excess of 200–300 rpms.

SUMMARY OF THE INVENTION

DUAL HEAD WINDING APPARATUS

The present invention differs from that of the aforementioned (033) patent in at least the following significant respects:

(1) The transfer mechanism is simplified by the use of only a single transfer arm and a collector arm for each mandrel and does not require the mounting of respective transfer arms for respective vertical and horizontal movement. Thus, the tranfer mechanism and operation in accordance with the present invention is not only less complex, but is more efficient and reliable in effecting a transfer of FM from a wound mandrel to an unwound mandrel. Additionally, the compact arrangement of side-side, mandrels as opposed to "stacked" mandrels enables the HSDHWA of the present invention to be more compact along the longitudinal axis thereof;

(2) The dual mandrels are spaced along a horizontal axis as opposed to a vertical axis of the winding apparatus, thereby affording easy access for the machine operator to unload completed windings from a wound spindle and enabling flexible material to be fed to the traverse guide in a direction perpendicular to the longitudinal axis of the HSDHWA with the traverse guide reciprocating in the same perpendicular direction, thereby enabling FM to be fed to the HSDHWA over the top thereof, which reduces the overall length of the HSDHWA including the supply for the FM.

(3) The traverse mechanism uses a unique rotating crank and connecting rod mounted to slide within a slider cart to obtain the required controllable reciprocating motion for winding FM onto the mandrels. The traverse mechanism operates at higher speeds than that of the barrel cam configurations of known traverse mechanisms, thereby improving the productivity of the HSDHWA.

A primary object of the present invention is to provide high speed winding apparatus for automatically transferring FM from one rotating winding diameter to another non-rotating winding diameter to enable the FM to be wound in an essentially non-stop operation, thereby greatly increasing the productivity of known dual head winding apparatus. For example, if the winding speed of the ON-LINE winding machine of the U.S. Pat. No. 4,477,033 patent×ft/sec., the speed of the HSDHWA of the invention is at least 1.5×ft/sec., or a 50% increase in winding speed.

Another primary object of the invention is to simplify and improve the reliability of transferring FM from a rotating wound mandrel to a stationary unwound mandrel while maintaining essentially a non-stop winding operation of the FM fed to the HSDHWA of the invention, thereby also attaining increased productivity of the winding operation.

Yet another primary object of the present invention is to provide a traverse mechanism capable of operating reliably at sustainable high winding speeds, thereby improving the productivity of the winding operation.

A further object of the present invention is to provide winding apparatus of the type specified herein which can be operated in either a fully automatic mode, requiring minimum operator attention, or in a semi-automatic mode, in which the operator can interrupt the automatic operation of the winding apparatus and perform various other functions that may be required in accordance with the type of FM being wound, for example.

Yet a further object of the invention is to provide such winding apparatus which is controllable by a pre-programmable microprocessor, thereby enabling a significantly greater versatility in the winding process, as well as enhancing the capability to wind a more diversified type of FM.

The above objects, features and advantages are achieved in the HSDHWA by a side-by-side, horizontal configuration of first and second spindle axes upon which are respectively mounted first and second mandrels. The traverse mechanism including the traverse guide is mounted on a platform that is movable between the spaced mandrels to wind FM onto an unwound mandrel from winding FM onto the wound mandrel. The traverse mechanism also participates in the transfer of FM from the wound mandrel onto the unwound mandrel by being withdrawn to its fullest "in" position, thereby causing the FM to be caught by the exposed grabber/cutter mechanism in the unwound mandrel. Significantly, the traverse mechanism includes a crank arm and connecting rod, the rotation of the crank arm producing a translation of the connecting rod end to which is attached a traverse guide for feeding FM to the particular mandrel being wound. This mechanism enables a high rate of traverse reciprocation thereby increasing the winding speed capability of the HSDHWA of the invention.

The transfer of FM from a wound mandrel to an unwound mandrel is accomplished by: (1) the cooperation and co-action of a pair of transfer arms, each transfer arm being operatively associated with a respective one of the mandrels; (2) controlled movements of the traverse guide assembly and traverse guide itself; and (3) the coordinated removal of a removable endform from the mandrel onto which the FM is to be transferred. This operation is controlled by the computer in response to various sensors that detect the status of the various mandrel and traverse mechanisms.

The FM is fed to the traverse guide from a supply of FM located to the rear of the HSDHWA and over the top of the HSDHWA via a "Giraffe-like" accumulator mounted to the top of the HSDHWA by a mounting assembly that includes a pneumatically operated linkage which lowers the "Giraffe-like" accumulator, thereby enabling the operator to easily feed the FM into the accumulator. The "Giraffe-like" accumulator also includes spring-loaded sheaves that provide proper tension of the FM as it is fed to the traverse guide.

TRAVERSE MECHANISM

The novel high speed traverse is designed to overcome the limitations of the old barrel cam traverse system by using the known slider crank principle and the use of very light weight graphite composite matrix material for the connecting rod, modern self-lubricating bearings in the connecting rod ends and self-lubricating flat bearing material exposed to the slider/guide assembly. The slider/guide assembly is entrapped in an outrigger/rail support which positions the filament guide over the mandrel/endform for correct filament deposition.

The connecting rod and slider are driven via a crank arm connected to the output shaft of a cam box. The cam is driven via a motor and is cut such that the output distortion is corrected and the desired output pattern is transmitted to the filament guide.

The primary advantages of the high speed traverse method and apparatus of the invention are that it is capable of operating at much higher cyclic rates and with increased operator safety than that of known traverse guide mechanisms.

BRIEF DESCRIPTION OF THE DRAWINGS

The above objects, features and advantages of the invention are readily apparent from the following description of a preferred embodiment representing the best mode of carrying out the invention when taken in conjunction with the drawings, wherein.

DETAILED DESCRIPTION OF THE DUAL HEAD WINDING APPARATUS

Figure 1:
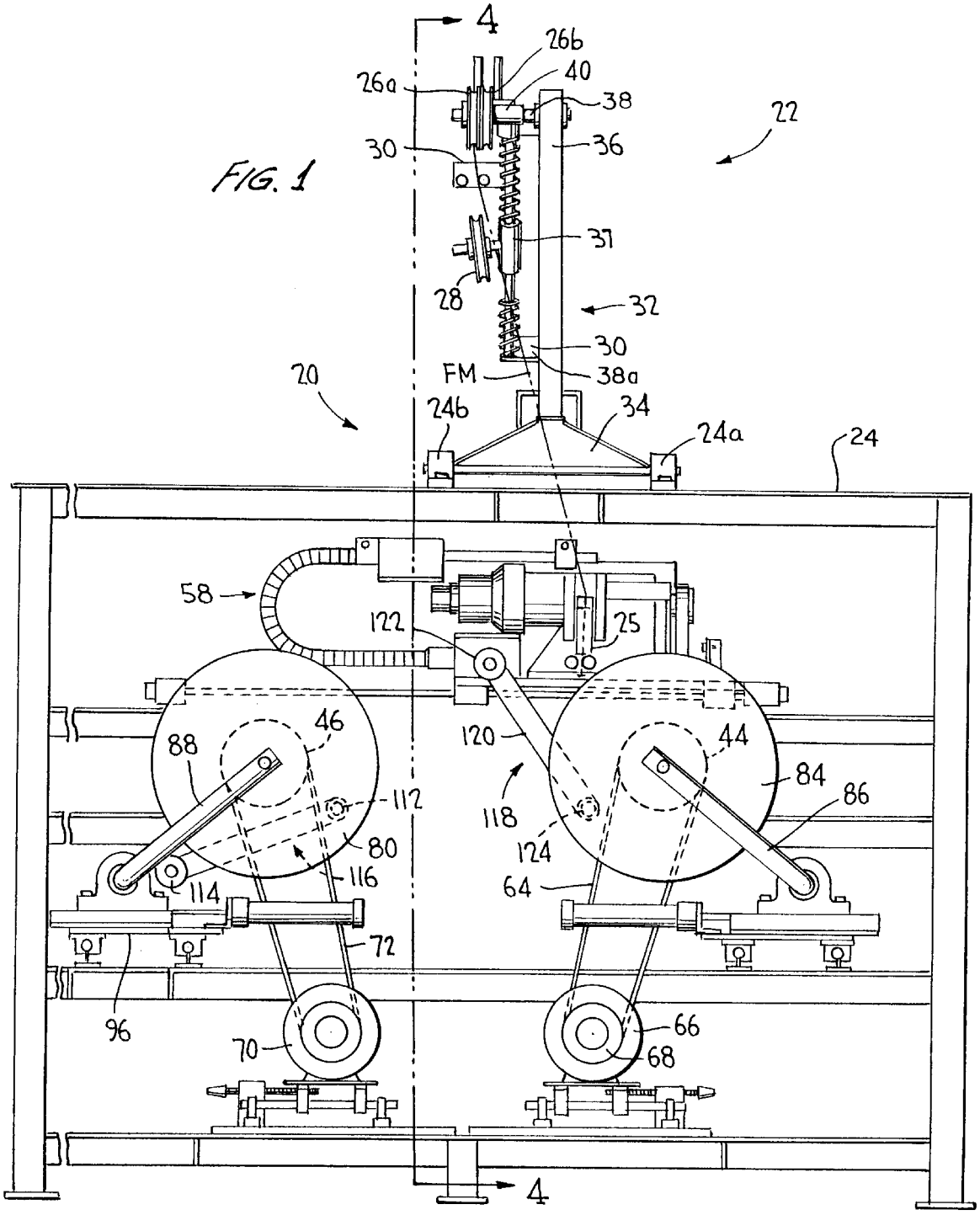
FIG. 1 is a front elevational view of the essential components of the dual head winding apparatus of the invention.
Figure 2:
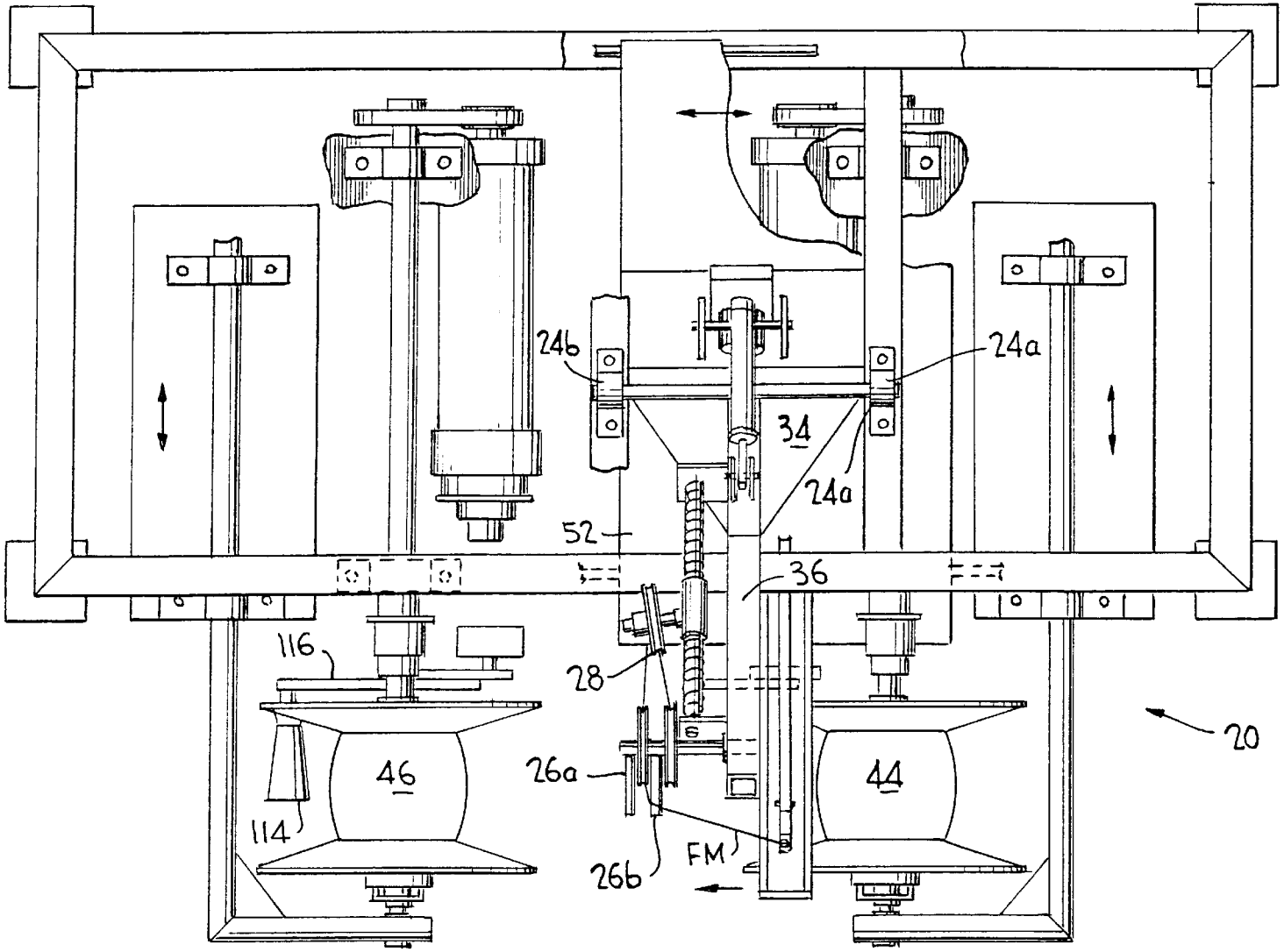
FIG. 2 is a top view of the essential components of the dual head winding apparatus of the invention.
Figure 3:
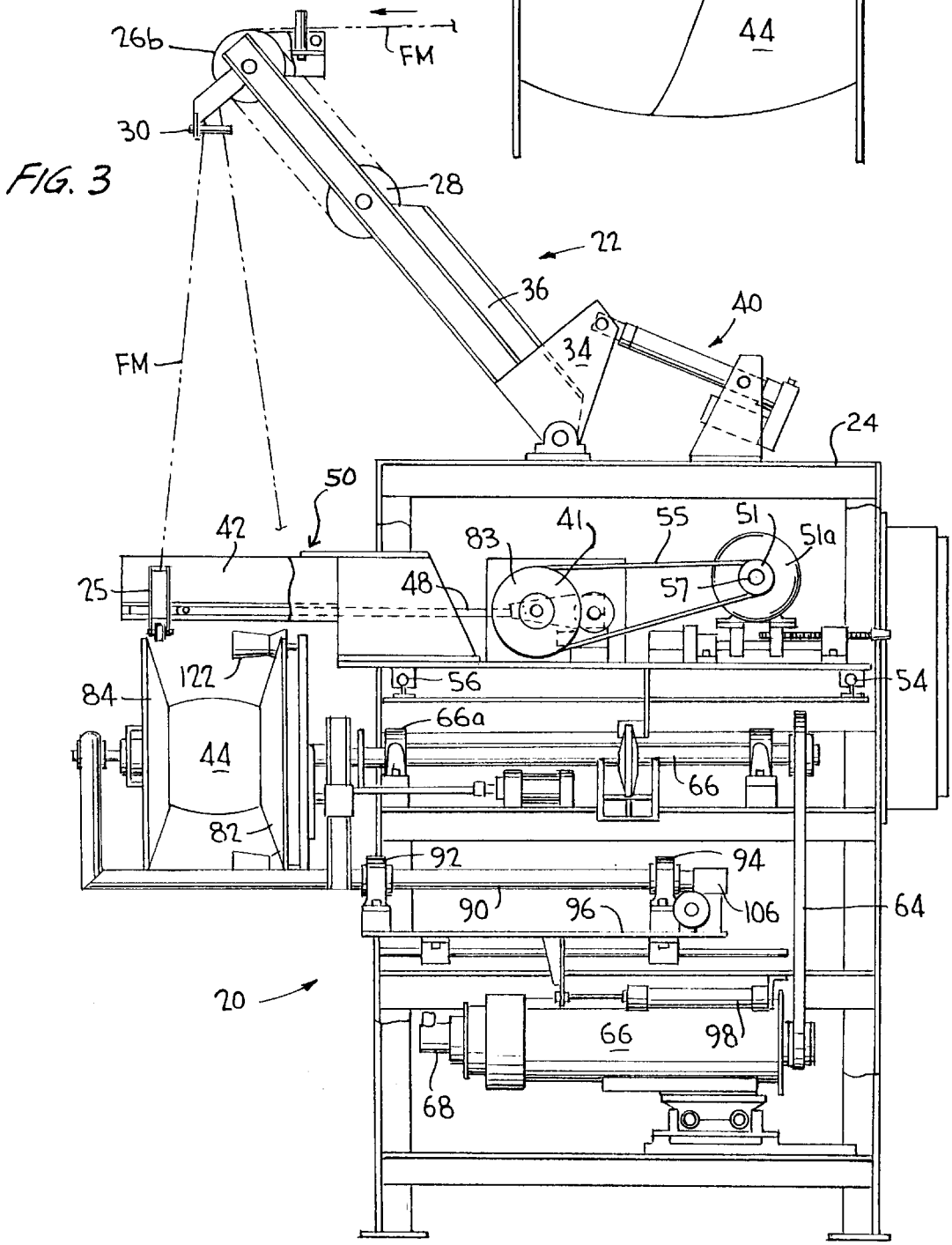
FIG. 3 is side view of the essential components of the dual head winding apparatus according to the invention.

With reference to FIGS. 1–3, (HSDHWA) 20 receives filamentary material FM from a supply of such material (not shown) that may exist in the form of a large supply spool of FM or directly from a line producing such FM material. The supply of FM may include an accumulator and/or dancer mechanism (not shown) known to those skilled in the winding apparatus art. The "Giraffe-like" input accumulator 22 of the HSDHWA is suitably mounted between top frame members 24 to feed FM to a traverse guide 25 to be more fully described hereinafter. The FM is fed between an upper pair of sheaves 26*a*, 26*b* and a single lower sheave 28 so that the FM exits input accumulator 22 from one of the upper sheaves 26*a* into the traverse guide 25 through guide 30 as best illustrated in FIGS. 1 and 3. Sheaves 26*a*, 26*b* and 28 are supported by a mounting assembly 32 comprising a base support 34 and bracket 36 as shown in FIGS. 1–3. As best illustrated in FIG. 1, lower sheave 28 is suspended from a spring-loaded bracket 37, which in turn is supported between posts 38, 38*a* attached to bracket 36 as shown in FIG. 1. The function of the spring-loaded bracket 36 is to provide the proper tension in the FM being fed to the traverse guide 25 as FM is wound on one of the two mandrels of the HSDHWA,as will be more fully described hereinafter. A tension of 10 to 20 pounds is adequate for the high speed operation of the HSDHWA. As best shown in FIG. 3 base support 34 and bracket 36 are rotatably mounted to support frames 24*a*, 24*b* so that the entirety of input accumulator 22 may be lowered by solenoid assembly 40, thereby enabling the operator to have easy access to sheaves 26*a*, 26*b* and 28 to string the FM in the accumulator 22.

With continuing reference to FIGS. 1 and 3, traverse guide 25 is mounted in sliding engagement within traverse guide chute 42 whereby traverse guide 25 is capable of respectively traversing across mandrels 44 and 46 (across mandrel 44 in FIG. 3) thereby enabling FM to be wound on one of the mandrels 44 or 46 at a time. Traverse guide 25 is shown in operative relationship with mandrel 44 in FIG. 2. Traverse guide 25 is reciprocated within traverse chute 42 by the rotation of crank arm 41 by traverse motor 51*a* and connecting rod 48 interconnecting crank arm 41 with traverse guide 25. In FIG. 3 pulley 51 on traverse motor 51*a* is connected with pulley 83 of the traverse mechanism 50 by belt 55. Encoder 57 provides information as to the position of the traverse guide 25 to the microprocessor (to be described hereinafter with respect to FIGS. 13*a*–13*c*).

Figure 4:
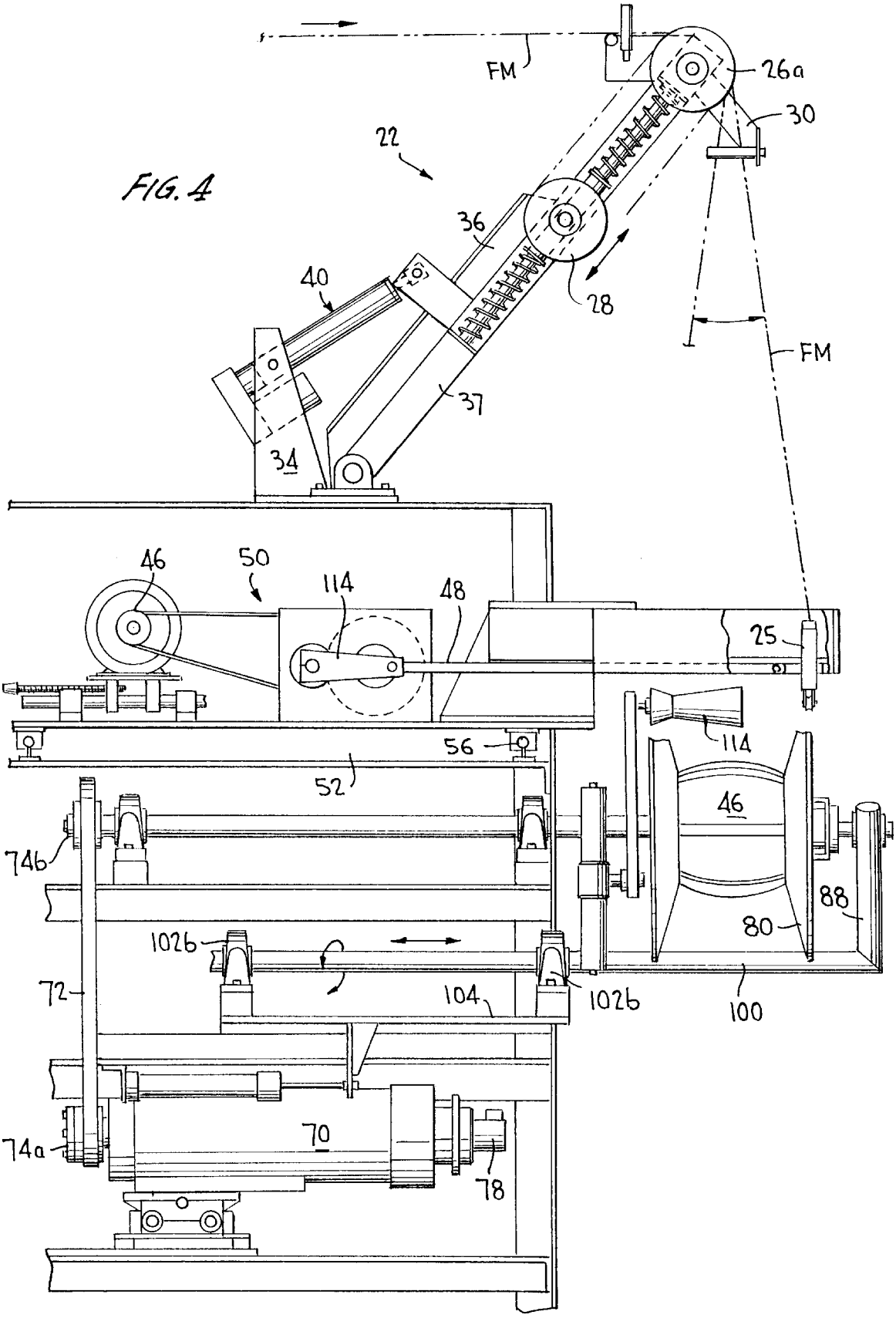
FIG. 4 is a cross section of the high speed dual head winding apparatus according to the invention and taken along lines 4—4 of FIG. 1.

With continuing reference to FIG. 3 and additional reference to FIG. 4 (which shows a cross section along the lines 4—4 of FIG. 1) traverse mechanism 50 is mounted on platform 52 which, in turn is mounted on spaced rails 54, 56 whereby the traverse mechanism 50 is moved laterally in either direction and (FIGS. 1 and 2) into operative position with respect to one of mandrels 44 and 46 for winding FM thereon. The lateral movement of platform 52 is effected by pneumatic actuator 58 under control of the microprocessor (to be described hereinafter with respect to FIGS. 13*a*–13*c*).

With continuing reference to FIGS. 1, 3 and 4, mandrels 44 and 46 are each rotated by a separate motor and drive assembly. Mandrel 44 (FIG. 3) is mounted on rotatable spindle axis shaft 60 within bearings 62*a*, 62*b*. Spindle axis shaft 60 is rotated by means of belt 64 connected between shaft 60 and shaft and mandrel drive motor 66. An encoder 68 is mounted to mandrel drive motor 66 to provide signals representative of the speed of rotation of the mandrel to the microprocessor to control the winding of FM onto mandrel 44 as will be more fully explained hereinafter with respect to FIGS. 13*a*–13*c*. With respect to FIGS. 1 and 4, mandrel 46 is driven in the same manner as just described for mandrel 44, with the exception that separately controlled motor 70 rotates mandrel 46 via belt 72, pulleys 74*a*, 74*b* and spindle axis shaft 76. Encoder 78 provides data pertaining to the speed of rotation of mandrel 46 to the microprocessor.

Mandrels 44 and 46 are respectively mounted to spindle axis shafts 60 and 76 and each mandrel may be of the type having an expandable base as is known to those skilled in the art. With respect to FIG. 4, mandrel 46 has a fixed endform 78 and a removable endform 80. Similarly, with respect to FIG. 3 mandrel 44 has a fixed endform 82 and a removable endform 84. An important feature of the invention is the manner in which the removable endforms 80 and 84 are each automatically/semi-automatically removed upon the completion of a wind thereon and transfer of the FM to the other mandrel. That is, a respective removable endform may be automatically removed under control of the microprocessor or, alternatively, the operator may control the initiation of the endform removal from a control station mounted to the front of the HSDHWA (not shown).

The mechanism for the mandrel endform removal is shown with respect to FIGS. 1, 3 and 4. With reference to FIG. 3, endform arm 86 holds endform 80 of mandrel 46 and endform arm 88 holds endform 84 of mandrel 44. Endform arms 86 and 88 are free to rotate downwardly, ie. endform arm 86 rotates clockwise and endform arm 88 rotates counterclockwise as viewed in FIG. 1. With specific reference to FIG. 3, endform arm 86 is fixed to endform shaft 90 which is rotatable in bearings 92, 94, which, in turn, are mounted to endform platform 96 which is movable bi-directionally as indicated by the bi-directional arrow in FIG. 4. Tile endform platform 96 is movable by a pneumatic cylinder 98 under control of the aforementioned microprocessor. However, it is understood that one of ordinary skill in the winding art will recognize that other means such as a screw, cable cylinder, etc. may be used in place of the pneumatic cylinder.

A similar arrangement is illustrated with respect to FIGS. 1 and 4 for the endform removal assembly for removing endform 46 (although not in the same detail as with respect to endform 84 (as just described) in which endform arm 88 is attached to endform removal shaft 100 which is carried by bearings 102*a*, 102*b*, which are mounted to endform platform 104. Endform platform 104 is movable by a pneumatic cylinder (not shown) in the same manner as previously described for endform platform 96.

Movement of the respective endform platforms 96 and 104 in an outwardly direction from the HSDHWA 20 causes the respective removable endform 80, 84 to be removed from the respective mandrel 46, 44. Upon removal of the endform, the respective endform arm is rotated downwardly (FIG. 1) and away from the respective mandrel, thereby providing the operator the necessary room to remove the winding from the mandrel. The endform arms 86 and 88 are shown in their normal position in FIG. 1, i.e with mandrel 44 being wound and mandrel 46 ready to receive FM transferred from the FM being wound onto mandrel 44. The mechanism for causing rotation of endform shaft 90 and endform arm 86 is a Geneva device 106 (FIG. 3) which is connected to shaft 90. Endform arm 88 and endform shaft 100 are rotated in a similar manner although the Geneva mechanism is not shown in the drawings (FIG. 4).

DETAILED DESCRIPTION OF THE TRAVERSE MECHANISM

Figure 5:
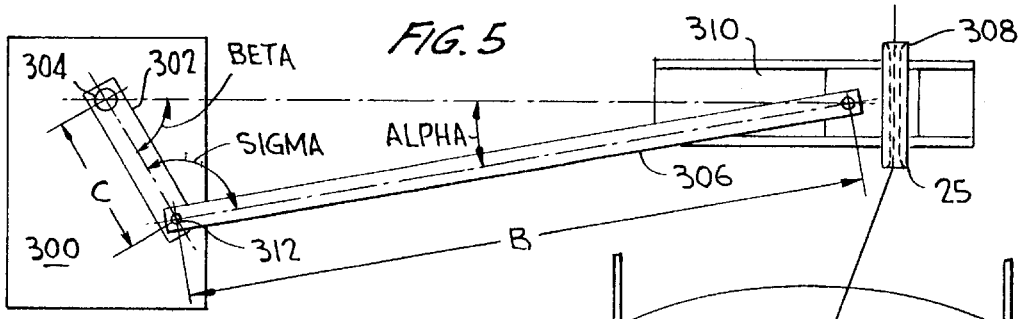
FIG. 5 illustrates the structure of the crank arm mechanism and traverse guide for producing the motion of the traverse in the dual head winding apparatus of the invention.

The following description is taken with respect to FIG. 5 wherein cam box 300 converts constant angular velocity at its input shaft to appropriate output shaft values of angular displacement, angular velocity and angular acceleration. Crank arm 302 is fastened to cam box output shaft 304 so that it rotates about the center of the output shaft with the aforementioned output values of angular displacement, angular velocity and angular acceleration. Connecting rod 306 is connected at one end to crank arm 302 and the other end thereof is connected to slider 308. The connecting rod 306 transforms the circular motion of the crank arm 302 to the linear motion of slider 308 along the axis X—X. A traverse guide 25 is affixed to slider 308 and distributes the FM in the appropriate pattern on the mandrel 44. Slider 308 is constrained to move along the X—X axis in an oscillatory manner with rotation of the crank arm 302. The FM is pulled through the traverse guide 25 as the mandrel 44 rotates. The displacement of the FM traverse guide 25 along the X—X axis is synchronized to the rotation of the mandrel 44 so as to yield a coil as described herein.

The cam box 300, cam box drive motor (not shown) and the slider/guide rail support 310 are all mounted inside a machine frame as described above with respect to FIGS. 1–4.

It is evident from a consideration of FIG. 5 that the position of the traverse guide 25 is a function of the angular position of the indexer input shaft 304. That position is measured as a positive or negative displacement from the traverse guide 25 center position. The position of traverse guide 25 upon its locus determines the angle alpha of the connecting rod 306, the angle beta of the crank arm 302 (which is the angular displacement of the index output shaft 312). Moreover, the angle sigma is formed between the connecting rod and crank arm 302. It is to be noted that the length of connecting rod 306 is constant as is the radius of the crank arm 302

The values of the traverse guide displacement, the ground link distance A, angle alpha, angle beta and angle sigma for each respective degree of rotation of the indexer input shaft 304 can be readily computed. Using the values of angle beta, a cam for the indexer can be created to yield the proper value of indexer output shaft angle for its respective input shaft angle. The cam then enables the appropriate traverse guide positional output as a function of the indexer shaft angle. The output data generated by the above calculations is set forth in Table I. From Table I it is observed that the wire guide displacement is determined from the variable "a" as a function of the constants "b" and "c" and the variable angles alpha, beta and sigma as function of the input shaft position in degrees. It is noted that angle beta is measured positive counter-clockwise from the X-axis; alpha is positive for the connecting rod 306 being above the X-axis and negative for the connecting rod 306 being below the X-axis.

CONTINUATION OF THE DETAILED DESCRIPTION OF THE HSDHWA

The remaining mechanical structure to be described pertains to a very important feature of the invention, namely, the transfer of input FM from a wound mandrel to an unwound mandrel without stopping the infeed of FM. This transfer is accomplished with: (1) the cooperation and co-action of a pair of transfer arms, each

TABLE I

| Input shaft degrees | a, ft | b, ft | c, ft | alpha, degrees | beta, degrees | sigma, degrees | wire guide displacement, ft |
|---|---|---|---|---|---|---|---|
| 0 | 3.000 | 2.5 | 0.5 | 0.00 | 0.00 | 180.00 | 0.500 |
| 1 | 3.000 | 2.5 | 0.5 | 0.23 | 1.14 | 178.63 | 0.500 |
| 2 | 3.000 | 2.5 | 0.5 | 0.46 | 2.28 | 177.27 | 0.500 |
| 3 | 2.999 | 2.5 | 0.5 | 0.68 | 3.42 | 175.90 | 0.499 |
| 4 | 2.998 | 2.5 | 0.5 | 0.91 | 4.56 | 174.53 | 0.498 |
| 5 | 2.997 | 2.5 | 0.5 | 1.14 | 5.70 | 173.17 | 0.497 |
| 6 | 2.996 | 2.5 | 0.5 | 1.36 | 6.83 | 171.80 | 0.496 |
| 7 | 2.994 | 2.5 | 0.5 | 1.59 | 7.97 | 170.44 | 0.494 |
| 8 | 2.992 | 2.5 | 0.5 | 1.82 | 9.11 | 169.07 | 0.492 |
| 9 | 2.990 | 2.5 | 0.5 | 2.04 | 10.25 | 167.71 | 0.490 |
| 10 | 2.988 | 2.5 | 0.5 | 2.26 | 11.39 | 166.34 | 0.488 |
| 11 | 2.986 | 2.5 | 0.5 | 2.49 | 12.54 | 164.98 | 0.486 |
| 12 | 2.983 | 2.5 | 0.5 | 2.71 | 13.68 | 163.61 | 0.483 |
| 13 | 2.980 | 2.5 | 0.5 | 2.93 | 14.82 | 162.25 | 0.490 |
| 14 | 2.977 | 2.5 | 0.5 | 3.15 | 15.96 | 160.89 | 0.477 |
| 15 | 2.974 | 2.5 | 0.5 | 3.37 | 17.10 | 159.53 | 0.474 |
| 16 | 2.970 | 2.5 | 0.5 | 3.59 | 18.24 | 158.17 | 0.470 |
| 17 | 2.966 | 2.5 | 0.5 | 3.81 | 19.39 | 156.81 | 0.466 |
| 18 | 2.962 | 2.5 | 0.5 | 4.02 | 20.53 | 155.45 | 0.462 |
| 19 | 2.958 | 2.5 | 0.5 | 4.24 | 21.68 | 154.09 | 0.458 |
| 20 | 2.953 | 2.5 | 0.5 | 4.45 | 22.82 | 152.73 | 0.453 |
| 21 | 2.949 | 2.5 | 0.5 | 4.65 | 23.98 | 151.37 | 0.449 |
| 22 | 2.944 | 2.5 | 0.5 | 4.87 | 25.11 | 150.02 | 0.444 |
| 23 | 2.939 | 2.5 | 0.5 | 5.08 | 26.26 | 148.66 | 0.439 |
| 24 | 2.933 | 2.5 | 0.5 | 5.28 | 27.41 | 147.31 | 0.433 |
| 25 | 2.928 | 2.5 | 0.5 | 5.49 | 28.56 | 145.96 | 0.428 |
| 26 | 2.922 | 2.5 | 0.5 | 5.69 | 29.71 | 144.61 | 0.422 |
| 27 | 2.916 | 2.5 | 0.5 | 5.89 | 30.85 | 143.26 | 0.516 |
| 28 | 2.910 | 2.5 | 0.5 | 6.09 | 32.01 | 141.91 | 0.410 |
| 29 | 2.904 | 2.5 | 0.5 | 6.28 | 33.16 | 140.56 | 0.404 |
| 30 | 2.897 | 2.5 | 0.5 | 6.47 | 34.31 | 139.21 | 0.397 |
| 31 | 2.890 | 2.5 | 0.5 | 6.66 | 35.45 | 137.89 | 0.390 |
| 32 | 2.884 | 2.5 | 0.5 | 6.84 | 36.56 | 136.60 | 0.384 |
| 33 | 2.877 | 2.5 | 0.5 | 7.02 | 37.64 | 135.34 | 0.377 |
| 34 | 2.871 | 2.5 | 0.5 | 7.18 | 38.70 | 134.11 | 0.371 |
| 35 | 2.864 | 2.5 | 0.5 | 7.35 | 39.74 | 132.91 | 0.364 |
| 36 | 2.857 | 2.5 | 0.5 | 7.50 | 40.76 | 131.74 | 0.357 |
| 37 | 2.851 | 2.5 | 0.5 | 7.65 | 41.75 | 130.59 | 0.351 |

TABLE I-continued

| Input shaft degrees | a, ft | b, ft | c, ft | alpha, degrees | beta, degrees | sigma, degrees | wire guide displacement, ft |
|---|---|---|---|---|---|---|---|
| 38 | 2.844 | 2.5 | 0.5 | 7.80 | 52.74 | 129.46 | 0.344 |
| 39 | 2.837 | 2.5 | 0.5 | 7.94 | 43.70 | 128.36 | 0.337 |
| 40 | 2.831 | 2.5 | 0.5 | 8.08 | 44.65 | 127.27 | 0.331 |
| 41 | 2.824 | 2.5 | 0.5 | 8.21 | 45.59 | 126.20 | 0.324 |
| 42 | 2.818 | 2.5 | 0.5 | 8.34 | 46.51 | 125.14 | 0.318 |
| 43 | 2.811 | 2.5 | 0.5 | 8.47 | 47.42 | 124.11 | 0.311 |
| 44 | 2.804 | 2.5 | 0.5 | 8.59 | 48.82 | 123.08 | 0.304 |
| 45 | 2.798 | 2.5 | 0.5 | 8.71 | 49.21 | 122.08 | 0.298 |
| 46 | 2.971 | 2.5 | 0.5 | 8.83 | 50.09 | 121.08 | 0.291 |
| 47 | 2.785 | 2.5 | 0.5 | 8.94 | 50.96 | 120.10 | 0.285 |
| 48 | 2.778 | 2.5 | 0.5 | 9.05 | 51.83 | 119.13 | 0.278 |
| 49 | 2.771 | 2.5 | 0.5 | 9.15 | 52.68 | 118.17 | 0.271 |
| 50 | 2.765 | 2.5 | 0.5 | 9.25 | 53.52 | 117.22 | 0.265 |
| 51 | 2.758 | 2.5 | 0.5 | 9.35 | 54.36 | 116.28 | 0.258 |
| 52 | 2.751 | 2.5 | 0.5 | 9.45 | 55.19 | 115.34 | 0.251 |
| 53 | 2.745 | 2.5 | 0.5 | 9.55 | 56.02 | 114.44 | 0.245 |
| 54 | 2.738 | 2.5 | 0.5 | 9.64 | 56.84 | 113.53 | 0.238 |
| 55 | 2.732 | 2.5 | 0.5 | 9.73 | 57.65 | 112.62 | 0.232 |
| 56 | 2.725 | 2.5 | 0.5 | 9.81 | 58.46 | 111.73 | 0.225 |
| 57 | 2.718 | 2.5 | 0.5 | 9.90 | 59.25 | 110.84 | 0.218 |
| 58 | 2.712 | 2.5 | 0.5 | 9.98 | 60.05 | 109.97 | 0.212 |
| 59 | 2.705 | 2.5 | 0.5 | 10.06 | 60.85 | 109.09 | 0.205 |
| 60 | 2.699 | 2.5 | 0.5 | 10.14 | 61.63 | 108.23 | 0.199 |
| 61 | 2.692 | 2.5 | 0.5 | 10.21 | 62.42 | 107.37 | 0.192 |
| 62 | 2.685 | 2.5 | 0.5 | 10.28 | 63.20 | 106.52 | 0.185 |
| 63 | 2.679 | 2.5 | 0.5 | 10.35 | 63.98 | 105.67 | 0.179 |
| 64 | 2.672 | 2.5 | 0.5 | 10.42 | 64.75 | 104.83 | 0.172 |
| 65 | 2.665 | 2.5 | 0.5 | 10.49 | 65.62 | 103.99 | 0.165 |
| 66 | 2.659 | 2.5 | 0.5 | 10.55 | 66.29 | 103.16 | 0.159 |
| 67 | 2.652 | 2.5 | 0.5 | 10.61 | 67.05 | 102.34 | 0.152 |
| 68 | 2.646 | 2.5 | 0.5 | 10.67 | 67.81 | 101.52 | 0.146 |
| 69 | 2.639 | 2.5 | 0.5 | 10.73 | 68.57 | 100.70 | 0.439 |
| 70 | 2.632 | 2.5 | 0.5 | 10.78 | 69.33 | 99.89 | 0.132 |
| 71 | 2.626 | 2.5 | 0.5 | 10.84 | 70.08 | 99.08 | 0.126 |
| 72 | 2.619 | 2.5 | 0.5 | 10.89 | 70.84 | 98.27 | 0.119 |
| 73 | 2.612 | 2.5 | 0.5 | 10.94 | 71.59 | 97.47 | 0.112 |
| 74 | 2.606 | 2.5 | 0.5 | 10.99 | 72.34 | 96.68 | 0.106 |
| 75 | 2.599 | 2.5 | 0.5 | 11.03 | 73.09 | 95.88 | 0.099 |
| 76 | 2.593 | 2.5 | 0.5 | 11.03 | 73.83 | 95.09 | 0.093 |
| 77 | 2.586 | 2.5 | 0.5 | 11.12 | 74.58 | 94.30 | 0.086 |
| 78 | 2.579 | 2.5 | 0.5 | 11.16 | 75.33 | 93.52 | 0.079 |
| 79 | 2.573 | 2.5 | 0.5 | 11.19 | 76.07 | 92.73 | 0.073 |
| 80 | 2.565 | 2.5 | 0.5 | 11.23 | 76.82 | 91.95 | 0.066 |
| 81 | 2.566 | 2.5 | 0.5 | 11.26 | 77.56 | 91.18 | 0.060 |
| 82 | 2.560 | 2.5 | 0.5 | 11.29 | 78.30 | 90.40 | 0.053 |
| 83 | 2.553 | 2.5 | 0.5 | 11.32 | 79.05 | 89.63 | 0.046 |
| 84 | 2.546 | 2.5 | 0.5 | 11.35 | 79.79 | 88.86 | 0.040 |
| 85 | 2.540 | 2.5 | 0.5 | 11.38 | 80.54 | 88.09 | 0.033 |
| 86 | 2.533 | 2.5 | 0.5 | 11.40 | 81.28 | 87.32 | 0.026 |
| 87 | 2.526 | 2.5 | 0.5 | 11.42 | 82.02 | 86.55 | 0.020 |
| 88 | 2.520 | 2.5 | 0.5 | 11.44 | 82.77 | 85.79 | 0.013 |
| 89 | 2.513 | 2.5 | 0.5 | 11.46 | 83.51 | 85.02 | 0.007 |
| 90 | 2.507 | 2.5 | 0.5 | 11.48 | 84.26 | 84.26 | 0.000 |
| 91 | 2.500 | 2.5 | 0.5 | 11.49 | 85.01 | 83.50 | −0.007 |
| 92 | 2.493 | 2.5 | 0.5 | 11.50 | 85.76 | 82.74 | −0.013 |
| 93 | 2.487 | 2.5 | 0.5 | 11.52 | 86.51 | 81.98 | −0.020 |
| 94 | 2.480 | 2.5 | 0.5 | 11.52 | 87.26 | 81.22 | −0.026 |
| 95 | 2.474 | 2.5 | 0.5 | 11.53 | 88.01 | 80.46 | −0.033 |
| 96 | 2.467 | 2.5 | 0.5 | 11.53 | 88.76 | 79.70 | −0.040 |
| 97 | 2.454 | 2.5 | 0.5 | 11.54 | 89.52 | 78.94 | −0.046 |
| 98 | 2.447 | 2.5 | 0.5 | 11.54 | 90.28 | 78.18 | −0.053 |
| 99 | 2.440 | 2.5 | 0.5 | 11.54 | 91.04 | 77.43 | −0.060 |
| 100 | 2.434 | 2.5 | 0.5 | 11.53 | 91.80 | 76.67 | −0.066 |
| 101 | 2.427 | 2.5 | 0.5 | 11.53 | 92.57 | 75.91 | −0.073 |
| 102 | 2.421 | 2.5 | 0.5 | 11.52 | 93.33 | 75.15 | −0.079 |
| 103 | 2.414 | 2.5 | 0.5 | 11.51 | 94.10 | 74.39 | −0.086 |
| 104 | 2.407 | 2.5 | 0.5 | 11.49 | 94.88 | 73.63 | −0.093 |
| 105 | 2.401 | 2.5 | 0.5 | 11.48 | 95.65 | 72.87 | −0.099 |
| 106 | 2.394 | 2.5 | 0.5 | 11.46 | 96.43 | 72.10 | −0.106 |
| 107 | 2.388 | 2.5 | 0.5 | 11.44 | 97.21 | 71.34 | −0.112 |
| 108 | 2.381 | 2.5 | 0.5 | 11.42 | 98.00 | 70.58 | −0.119 |
| 109 | 2.374 | 2.5 | 0.5 | 11.40 | 98.79 | 69.81 | −0.126 |
| 110 | 2.368 | 2.5 | 0.5 | 11.37 | 99.58 | 69.04 | −0.132 |
| 111 | 2.361 | 2.5 | 0.5 | 11.35 | 100.38 | 68.27 | −0.139 |
| 112 | 2.354 | 2.5 | 0.5 | 11.31 | 101.19 | 67.50 | −0.146 |
| 113 | 2.348 | 2.5 | 0.5 | 11.28 | 101.99 | 66.73 | −0.152 |
| 114 | 2.341 | 2.5 | 0.5 | 11.25 | 102.80 | 65.95 | −0.159 |

TABLE I-continued

| Input shaft degrees | a, ft | b, ft | c, ft | alpha, degrees | beta, degrees | sigma, degrees | wire guide displacement, ft |
|---|---|---|---|---|---|---|---|
| 115 | 2.335 | 2.5 | 0.5 | 11.21 | 103.62 | 65.17 | −0.165 |
| 116 | 2.328 | 2.5 | 0.5 | 11.17 | 104.44 | 64.39 | −0.172 |
| 117 | 2.321 | 2.5 | 0.5 | 11.12 | 105.27 | 63.60 | −0.179 |
| 118 | 2.315 | 2.5 | 0.5 | 11.08 | 106.11 | 62.82 | −0.185 |
| 119 | 2.308 | 2.5 | 0.5 | 11.03 | 106.95 | 62.03 | −0.192 |
| 120 | 2.301 | 2.5 | 0.5 | 10.98 | 107.79 | 61.23 | −0.199 |
| 121 | 2.295 | 2.5 | 0.5 | 10.92 | 108.64 | 60.43 | −0.205 |
| 122 | 2.288 | 2.5 | 0.5 | 10.87 | 109.50 | 59.63 | −0.212 |
| 123 | 2.282 | 2.5 | 0.5 | 10.81 | 110.37 | 58.62 | −0.218 |
| 124 | 2.275 | 2.5 | 0.5 | 10.74 | 111.24 | 58.01 | −0.225 |
| 125 | 2.268 | 2.5 | 0.5 | 10.68 | 112.13 | 57.20 | −0.232 |
| 126 | 2.262 | 2.5 | 0.5 | 10.61 | 113.02 | 56.37 | −0.238 |
| 127 | 2.255 | 2.5 | 0.5 | 10.53 | 113.92 | 55.55 | −0.245 |
| 128 | 2.249 | 2.5 | 0.5 | 10.46 | 114.83 | 54.72 | −0.251 |
| 129 | 2.242 | 2.5 | 0.5 | 10.38 | 115.74 | 53.88 | −0.258 |
| 130 | 2.235 | 2.5 | 0.5 | 10.29 | 116.67 | 53.03 | −0.265 |
| 131 | 2.229 | 2.5 | 0.5 | 10.21 | 117.61 | 52.18 | −0.271 |
| 132 | 2.222 | 2.5 | 0.5 | 10.12 | 118.56 | 51.32 | −0.278 |
| 133 | 2.215 | 2.5 | 0.5 | 10.02 | 119.53 | 50.45 | −0.285 |
| 134 | 2.209 | 2.5 | 0.5 | 9.92 | 123.50 | 49.58 | −0.291 |
| 135 | 2.202 | 2.5 | 0.5 | 9.82 | 121.43 | 48.69 | −0.298 |
| 136 | 2.196 | 2.5 | 0.5 | 9.71 | 122.49 | 47.80 | −0.304 |
| 137 | 2.189 | 2.5 | 0.5 | 9.60 | 123.51 | 46.89 | −0.311 |
| 138 | 2.182 | 2.5 | 0.5 | 9.48 | 124.54 | 45.98 | −0.318 |
| 139 | 2.176 | 2.5 | 0.5 | 9.36 | 125.59 | 45.05 | −0.324 |
| 140 | 2.169 | 2.5 | 0.5 | 9.21 | 126.65 | 44.11 | −0.331 |
| 141 | 2.168 | 2.5 | 0.5 | 9.10 | 127.74 | 43.16 | −0.337 |
| 142 | 2.156 | 2.5 | 0.5 | 8.96 | 128.84 | 42.20 | −0.344 |
| 143 | 2.149 | 2.5 | 0.5 | 8.82 | 129.97 | 41.21 | −0.351 |
| 144 | 2.143 | 2.5 | 0.5 | 8.67 | 131.12 | 40.22 | −0.357 |
| 145 | 2.136 | 2.5 | 0.5 | 8.51 | 132.29 | 39.20 | −0.364 |
| 146 | 2.129 | 2.5 | 0.5 | 8.84 | 133.49 | 38.17 | −0.371 |
| 147 | 2.123 | 2.5 | 0.5 | 8.17 | 134.72 | 37.11 | −0.377 |
| 148 | 2.116 | 2.5 | 0.5 | 7.99 | 135.98 | 36.03 | −0.384 |
| 149 | 2.110 | 2.5 | 0.5 | 7.80 | 137.27 | 24.93 | −0.390 |
| 150 | 2.103 | 2.5 | 0.5 | 7.60 | 138.61 | 33.79 | −0.397 |
| 151 | 2.096 | 2.5 | 0.5 | 7.39 | 139.96 | 32.65 | −0.404 |
| 152 | 2.090 | 2.5 | 0.5 | 7.18 | 141.31 | 31.50 | −0.410 |
| 153 | 2.084 | 2.5 | 0.5 | 6.97 | 142.67 | 30.36 | −0.416 |
| 154 | 2.078 | 2.5 | 0.5 | 6.75 | 144.03 | 29.22 | −0.422 |
| 155 | 2.072 | 2.5 | 0.5 | 6.52 | 145.39 | 28.08 | −0.428 |
| 156 | 2.067 | 2.5 | 0.5 | 6.29 | 146.76 | 26.95 | −0.433 |
| 157 | 2.061 | 2.5 | 0.5 | 6.06 | 148.13 | 25.81 | −0.439 |
| 158 | 2.056 | 2.5 | 0.5 | 6.83 | 143.50 | 24.68 | −0.444 |
| 159 | 2.051 | 2.5 | 0.5 | 5.59 | 150.87 | 26.55 | −0.449 |
| 160 | 2.047 | 2.5 | 0.5 | 5.34 | 152.24 | 22.41 | −0.453 |
| 161 | 2.042 | 2.5 | 0.5 | 5.10 | 153.62 | 21.28 | −0.458 |
| 162 | 2.038 | 2.5 | 0.5 | 4.85 | 154.99 | 20.16 | −0.462 |
| 163 | 2.034 | 2.5 | 0.5 | 4.60 | 156.37 | 19.03 | −0.466 |
| 164 | 2.030 | 2.5 | 0.5 | 4.34 | 157.75 | 17.90 | −0.470 |
| 165 | 2.026 | 2.5 | 0.5 | 4.08 | 159.14 | 16.78 | −0.476 |
| 166 | 2.023 | 2.5 | 0.5 | 3.82 | 160.52 | 15.66 | −0.477 |
| 167 | 2.020 | 2.5 | 0.5 | 3.56 | 161.90 | 14.53 | −0.480 |
| 168 | 2.017 | 2.5 | 0.5 | 3.30 | 163.29 | 13.41 | −0.483 |
| 169 | 2.014 | 2.5 | 0.5 | 3.03 | 164.68 | 12.29 | −0.486 |
| 170 | 2.012 | 2.5 | 0.5 | 2.76 | 166.07 | 11.17 | −0.488 |
| 171 | 2.010 | 2.5 | 0.5 | 2.49 | 167.46 | 10.05 | −0.490 |
| 172 | 2.008 | 2.5 | 0.5 | 2.22 | 168.85 | 8.93 | −0.492 |
| 173 | 2.006 | 2.5 | 0.5 | 1.94 | 170.24 | 7.82 | −0.494 |
| 174 | 2.004 | 2.5 | 0.5 | 1.67 | 171.63 | 6.70 | −0.496 |
| 175 | 2.003 | 2.5 | 0.5 | 1.39 | 173.03 | 5.58 | −0.497 |
| 176 | 2.002 | 2.5 | 0.5 | 1.11 | 174.42 | 4.46 | −0.498 |
| 177 | 2.001 | 2.5 | 0.5 | 0.84 | 175.82 | 3.35 | −0.499 |
| 178 | 2.000 | 2.5 | 0.5 | 0.56 | 177.21 | 2.23 | −0.500 |
| 179 | 2.000 | 2.5 | 0.5 | 0.28 | 178.61 | 1.12 | −0.500 |
| 180 | 2.000 | 2.5 | 0.5 | 0.00 | −180.00 | 360.00 | −0.500 |
| 181 | 2.000 | 2.5 | 0.5 | −0.28 | −178.81 | 1.12 | −0.500 |
| 182 | 2.000 | 2.5 | 0.5 | −0.56 | −177.21 | 2.23 | −0.500 |
| 183 | 2.001 | 2.5 | 0.5 | −0.84 | −175.82 | 3.35 | −0.499 |
| 184 | 2.002 | 2.5 | 0.5 | −1.11 | −174.42 | 4.46 | −0.498 |
| 185 | 2.003 | 2.5 | 0.5 | −1.39 | −173.03 | 5.58 | −0.497 |
| 186 | 2.004 | 2.5 | 0.5 | −1.67 | −171.63 | 6.70 | −0.496 |
| 187 | 2.006 | 2.5 | 0.5 | −1.94 | −170.24 | 7.82 | −0.494 |
| 188 | 2.008 | 2.5 | 0.5 | −2.22 | −168.85 | 8.93 | −0.492 |
| 189 | 2.010 | 2.5 | 0.5 | −2.49 | −167.46 | 10.05 | −0.490 |
| 190 | 2.012 | 2.5 | 0.5 | −2.76 | −166.07 | 11.17 | −0.488 |
| 191 | 2.014 | 2.5 | 0.5 | −3.03 | −164.68 | 12.29 | −0.486 |

TABLE I-continued

| Input shaft degrees | a, ft | b, ft | c, ft | alpha, degrees | beta, degrees | sigma, degrees | wire guide displacement, ft |
|---|---|---|---|---|---|---|---|
| 192 | 2.017 | 2.5 | 0.5 | −3.30 | −163.29 | 13.41 | −0.483 |
| 193 | 2.020 | 2.5 | 0.5 | −3.56 | −161.90 | 14.53 | −0.480 |
| 194 | 2.023 | 2.5 | 0.5 | −3.82 | −160.52 | 15.66 | −0.477 |
| 195 | 2.026 | 2.5 | 0.5 | −4.08 | −159.14 | 16.78 | −0.474 |
| 196 | 2.030 | 2.5 | 0.5 | −4.34 | −157.75 | 17.90 | −0.470 |
| 197 | 2.034 | 2.5 | 0.5 | −4.60 | −135.37 | 19.83 | −0.466 |
| 198 | 2.038 | 2.5 | 0.5 | −4.96 | −154.99 | 20.16 | −0.462 |
| 199 | 2.042 | 2.5 | 0.5 | −5.10 | −153.62 | 21.28 | −0.458 |
| 200 | 2.047 | 2.5 | 0.5 | −5.24 | −152.24 | 22.41 | −0.453 |
| 201 | 2.051 | 2.5 | 0.5 | −5.59 | −150.87 | 23.55 | −0.443 |
| 202 | 2.056 | 2.5 | 0.5 | −5.63 | −149.50 | 24.68 | −0.444 |
| 203 | 2.061 | 2.5 | 0.5 | −6.06 | −148.13 | 26.81 | −0.439 |
| 204 | 2.062 | 2.5 | 0.5 | −6.29 | −146.76 | 26.95 | −0.433 |
| 205 | 2.072 | 2.5 | 0.5 | −6.52 | −145.39 | 28.08 | −0.428 |
| 206 | 2.078 | 2.5 | 0.5 | −6.73 | −144.03 | 22.22 | −0.422 |
| 207 | 2.084 | 2.5 | 0.5 | −6.97 | −142.67 | 30.35 | −0.416 |
| 208 | 2.090 | 2.5 | 0.5 | −7.18 | −141.31 | 31.50 | −0.410 |
| 209 | 2.096 | 2.5 | 0.5 | −7.39 | −139.95 | 32.65 | −0.404 |
| 210 | 2.103 | 2.5 | 0.5 | −7.60 | −138.61 | 33.73 | −0.397 |
| 211 | 2.110 | 2.5 | 0.5 | −7.80 | −137.27 | 34.93 | −0.388 |
| 212 | 2.115 | 2.5 | 0.5 | −7.99 | −135.98 | 36.03 | −0.384 |
| 213 | 2.123 | 2.5 | 0.5 | −8.17 | −134.72 | 37.11 | −0.377 |
| 214 | 2.129 | 2.5 | 0.5 | −8.34 | −133.49 | 38.17 | −0.371 |
| 215 | 2.136 | 2.5 | 0.5 | −8.51 | −132.29 | 39.20 | −0.364 |
| 216 | 2.143 | 2.5 | 0.5 | −8.67 | −131.12 | 40.22 | −0.357 |
| 217 | 2.149 | 2.5 | 0.5 | −8.82 | −128.97 | 41.21 | −0.351 |
| 218 | 2.156 | 2.5 | 0.5 | −8.96 | −128.94 | 42.20 | −0.344 |
| 219 | 2.163 | 2.5 | 0.5 | −9.10 | −127.74 | 43.15 | −0.337 |
| 220 | 2.169 | 2.5 | 0.5 | −9.23 | −126.66 | 44.11 | −0.331 |
| 221 | 2.176 | 2.5 | 0.5 | −9.36 | −125.59 | 45.05 | −0.324 |
| 222 | 2.182 | 2.5 | 0.5 | −9.48 | −124.54 | 45.98 | −0.313 |
| 223 | 2.189 | 2.5 | 0.5 | −9.40 | −123.51 | 46.89 | −0.311 |
| 224 | 2.196 | 2.5 | 0.5 | −9.71 | −122.43 | 47.80 | −0.308 |
| 225 | 2.202 | 2.5 | 0.5 | −9.82 | −121.49 | 48.69 | −0.298 |
| 226 | 2.209 | 2.5 | 0.5 | −9.92 | −120.50 | 49.58 | −0.291 |
| 227 | 2.215 | 2.5 | 0.5 | −10.02 | −113.53 | 50.45 | −0.285 |
| 228 | 2.222 | 2.5 | 0.5 | −10.12 | −118.56 | 51.32 | −0.278 |
| 229 | 2.229 | 2.5 | 0.5 | −10.21 | −117.61 | 52.18 | −0.277 |
| 230 | 2.235 | 2.5 | 0.5 | −10.23 | −116.67 | 53.07 | −0.265 |
| 231 | 2.242 | 2.5 | 0.5 | −10.38 | −115.74 | 53.88 | −0.258 |
| 232 | 2.243 | 2.5 | 0.5 | −10.44 | −114.83 | 54.72 | −0.251 |
| 233 | 2.255 | 2.5 | 0.5 | −10.52 | −113.92 | 55.55 | −0.245 |
| 234 | 2.262 | 2.5 | 0.5 | −10.61 | −113.02 | 56.37 | −0.238 |
| 235 | 2.268 | 2.5 | 0.5 | −10.68 | −112.13 | 57.20 | −0.232 |
| 236 | 2.275 | 2.5 | 0.5 | −10.74 | −111.24 | 58.01 | −0.225 |
| 237 | 2.283 | 2.5 | 0.5 | −10.81 | −110.37 | 59.52 | −0.218 |
| 238 | 2.288 | 2.5 | 0.5 | −10.87 | −109.50 | 59.63 | −0.212 |
| 239 | 2.295 | 2.5 | 0.5 | −10.92 | −108.64 | 60.43 | −0.205 |
| 240 | 2.301 | 2.5 | 0.5 | −10.98 | −107.79 | 61.23 | −0.199 |
| 241 | 2.308 | 2.5 | 0.5 | −11.03 | −106.95 | 62.03 | −0.188 |
| 242 | 2.315 | 2.5 | 0.5 | −11.08 | −106.11 | 62.82 | −0.185 |
| 243 | 2.321 | 2.5 | 0.5 | −11.12 | −105.27 | 63.60 | −0.179 |
| 244 | 2.323 | 2.5 | 0.5 | −11.17 | −104.44 | 64.39 | −0.172 |
| 245 | 2.335 | 2.5 | 0.5 | −11.21 | −103.62 | 65.17 | −0.165 |
| 246 | 2.341 | 2.5 | 0.5 | −11.25 | −102.80 | 65.35 | −0.159 |
| 247 | 2.348 | 2.5 | 0.5 | −11.28 | −101.99 | 66.73 | −0.152 |
| 248 | 2.354 | 2.5 | 0.5 | −11.31 | −101.19 | 67.50 | −0.140 |
| 249 | 2.361 | 2.5 | 0.5 | −11.35 | −100.38 | 68.27 | −0.139 |
| 250 | 2.363 | 2.5 | 0.5 | −11.37 | −99.58 | 69.04 | −0.132 |
| 251 | 2.374 | 2.5 | 0.5 | −11.40 | −98.79 | 69.91 | −0.126 |
| 252 | 2.381 | 2.5 | 0.5 | −11.42 | −98.00 | 70.58 | −0.113 |
| 253 | 2.388 | 2.5 | 0.5 | −11.44 | −97.21 | 71.38 | −0.112 |
| 254 | 2.394 | 2.5 | 0.5 | −11.45 | −96.43 | 72.10 | −0.104 |
| 255 | 2.401 | 2.5 | 0.5 | −11.48 | −95.55 | 72.87 | −0.099 |
| 256 | 2.407 | 2.5 | 0.5 | −11.49 | −94.86 | 73.63 | −0.093 |
| 257 | 2.414 | 2.5 | 0.5 | −11.51 | −94.10 | 74.39 | −0.086 |
| 258 | 2.421 | 2.5 | 0.5 | −11.52 | −93.33 | 75.15 | −0.079 |
| 259 | 2.427 | 2.5 | 0.5 | −11.53 | −92.57 | 75.91 | −0.073 |
| 260 | 2.434 | 2.5 | 0.5 | −11.53 | −91.80 | 76.67 | −0.065 |
| 261 | 2.440 | 2.5 | 0.5 | −11.54 | −91.04 | 77.43 | −0.060 |
| 262 | 2.447 | 2.5 | 0.5 | −11.54 | −90.28 | 78.48 | −0.053 |
| 263 | 2.454 | 2.5 | 0.5 | −11.54 | −89.52 | 78.94 | −0.046 |
| 264 | 2.460 | 2.5 | 0.5 | −11.53 | −88.76 | 79.70 | −0.040 |
| 265 | 2.467 | 2.5 | 0.5 | −11.53 | −88.01 | 80.46 | −0.033 |
| 266 | 2.474 | 2.5 | 0.5 | −11.52 | −87.26 | 81.22 | −0.026 |
| 267 | 2.480 | 2.5 | 0.5 | −11.52 | −86.51 | 81.98 | −0.020 |
| 268 | 2.487 | 2.5 | 0.5 | −11.50 | −85.76 | 82.74 | −0.013 |

TABLE I-continued

| Input shaft degrees | a, ft | b, ft | c, ft | alpha, degrees | beta, degrees | sigma, degrees | wire guide displacement, ft |
|---|---|---|---|---|---|---|---|
| 269 | 2.493 | 2.5 | 0.5 | −11.49 | −85.01 | 83.50 | −0.007 |
| 270 | 2.500 | 2.5 | 0.5 | −11.48 | −84.26 | 84.26 | 0.000 |
| 271 | 2.507 | 2.5 | 0.5 | −11.46 | −83.51 | 85.02 | 0.007 |
| 272 | 2.513 | 2.5 | 0.5 | −11.44 | −82.77 | 85.79 | 0.013 |
| 273 | 2.520 | 2.5 | 0.5 | −11.42 | −82.02 | 86.55 | 0.020 |
| 274 | 2.526 | 2.5 | 0.5 | −11.40 | −81.28 | 87.32 | 0.026 |
| 275 | 2.533 | 2.5 | 0.5 | −11.38 | −80.54 | 88.09 | 0.033 |
| 276 | 2.540 | 2.5 | 0.5 | −11.35 | −79.79 | 88.86 | 0.040 |
| 277 | 2.546 | 2.5 | 0.5 | −11.32 | −79.05 | 89.63 | 0.046 |
| 278 | 2.553 | 2.5 | 0.5 | −11.29 | −78.30 | 90.40 | 0.053 |
| 279 | 2.560 | 2.5 | 0.5 | −11.26 | −77.56 | 91.18 | 0.060 |
| 280 | 2.566 | 2.5 | 0.5 | −11.23 | −76.82 | 91.95 | 0.066 |
| 281 | 2.573 | 2.5 | 0.5 | −11.19 | −76.07 | 92.73 | 0.073 |
| 282 | 2.579 | 2.5 | 0.5 | −11.16 | −75.33 | 93.52 | 0.079 |
| 283 | 2.586 | 2.5 | 0.5 | −11.12 | −74.58 | 94.30 | 0.086 |
| 284 | 2.593 | 2.5 | 0.5 | −11.07 | −73.83 | 95.09 | 0.093 |
| 285 | 2.599 | 2.5 | 0.5 | −11.03 | −73.09 | 95.88 | 0.099 |
| 286 | 2.606 | 2.5 | 0.5 | −10.99 | −72.34 | 96.68 | 0.106 |
| 287 | 2.612 | 2.5 | 0.5 | −10.94 | −71.59 | 97.47 | 0.112 |
| 288 | 2.619 | 2.5 | 0.5 | −10.89 | −70.84 | 98.27 | 0.119 |
| 289 | 2.626 | 2.5 | 0.5 | −10.14 | −70.08 | 99.08 | 0.126 |
| 290 | 2.632 | 2.5 | 0.5 | −10.78 | −69.33 | 99.89 | 0.132 |
| 291 | 2.639 | 2.5 | 0.5 | −10.73 | −68.57 | 100.70 | 0.139 |
| 292 | 2.646 | 2.5 | 0.5 | −10.67 | −67.81 | 101.52 | 0.146 |
| 293 | 2.652 | 2.5 | 0.5 | −10.61 | −67.05 | 102.34 | 0.152 |
| 294 | 2.659 | 2.5 | 0.5 | −10.55 | −66.29 | 103.16 | 0.159 |
| 295 | 2.665 | 2.5 | 0.5 | −10.49 | −65.52 | 103.99 | 0.165 |
| 296 | 2.672 | 2.5 | 0.5 | −10.42 | −64.75 | 104.83 | 0.172 |
| 297 | 2.679 | 2.5 | 0.5 | −10.35 | −63.98 | 105.67 | 0.179 |
| 298 | 2.685 | 2.5 | 0.5 | −10.28 | −63.20 | 106.52 | 0.185 |
| 299 | 2.692 | 2.5 | 0.5 | −10.21 | −62.42 | 107.37 | 0.192 |
| 300 | 2.699 | 2.5 | 0.5 | −10.14 | −61.63 | 108.23 | 0.199 |
| 301 | 2.705 | 2.5 | 0.5 | −10.06 | −60.85 | 109.09 | 0.205 |
| 302 | 2.712 | 2.5 | 0.5 | −9.98 | −60.05 | 109.97 | 0.212 |
| 303 | 2.718 | 2.5 | 0.5 | −9.90 | −59.26 | 110.04 | 0.218 |
| 304 | 2.725 | 2.5 | 0.5 | −9.81 | −58.46 | 111.73 | 0.225 |
| 305 | 2.732 | 2.5 | 0.5 | −9.73 | −57.65 | 112.62 | 0.232 |
| 306 | 2.738 | 2.5 | 0.5 | −9.64 | −56.84 | 113.53 | 0.238 |
| 307 | 2.745 | 2.5 | 0.5 | −9.55 | −56.02 | 114.44 | 0.245 |
| 308 | 2.751 | 2.5 | 0.5 | −9.45 | −55.19 | 115.35 | 0.251 |
| 309 | 2.758 | 2.5 | 0.5 | −9.35 | −54.36 | 116.28 | 0.258 |
| 310 | 2.765 | 2.5 | 0.5 | −9.25 | −53.52 | 117.22 | 0.265 |
| 311 | 2.771 | 2.5 | 0.5 | −9.15 | −52.68 | 118.17 | 0.271 |
| 312 | 2.778 | 2.5 | 0.5 | −9.05 | −51.83 | 119.13 | 0.278 |
| 313 | 2.785 | 2.5 | 0.5 | −8.94 | −50.95 | 123.10 | 0.285 |
| 314 | 2.791 | 2.5 | 0.5 | −8.83 | −50.09 | 121.08 | 0.291 |
| 315 | 2.798 | 2.5 | 0.5 | −8.71 | −49.21 | 122.08 | 0.298 |
| 316 | 2.804 | 2.5 | 0.5 | −8.59 | −48.32 | 123.08 | 0.304 |
| 317 | 2.811 | 2.5 | 0.5 | −8.47 | −47.42 | 124.11 | 0.311 |
| 318 | 2.818 | 2.5 | 0.5 | −8.34 | −46.51 | 125.14 | 0.318 |
| 319 | 2.824 | 2.5 | 0.5 | −8.21 | −45.59 | 126.20 | 0.324 |
| 320 | 2.831 | 2.5 | 0.5 | −8.08 | −44.65 | 127.27 | 0.331 |
| 321 | 2.837 | 2.5 | 0.5 | −7.94 | −43.70 | 128.36 | 0.337 |
| 322 | 2.844 | 2.5 | 0.5 | −7.80 | −42.74 | 129.46 | 0.344 |
| 323 | 2.851 | 2.5 | 0.5 | −7.65 | −41.75 | 130.59 | 0.351 |
| 324 | 2.857 | 2.5 | 0.5 | −7.50 | −40.76 | 131.74 | 0.357 |
| 325 | 2.864 | 2.5 | 0.5 | −7.35 | −39.74 | 132.91 | 0.364 |
| 326 | 2.871 | 2.5 | 0.5 | −7.18 | −38.70 | 134.11 | 0.371 |
| 327 | 2.877 | 2.5 | 0.5 | −7.02 | −37.64 | 135.34 | 0.377 |
| 328 | 2.884 | 2.5 | 0.5 | −6.84 | −36.56 | 136.60 | 0.384 |
| 329 | 2.890 | 2.5 | 0.5 | −6.66 | −35.45 | 137.89 | 0.390 |
| 330 | 2.897 | 2.5 | 0.5 | −6.47 | −34.31 | 139.21 | 0.397 |
| 331 | 2.904 | 2.5 | 0.5 | −6.28 | −33.16 | 140.56 | 0.404 |
| 332 | 2.910 | 2.5 | 0.5 | −6.09 | −32.01 | 141.91 | 0.410 |
| 333 | 2.916 | 2.5 | 0.5 | −5.89 | −30.86 | 143.25 | 0.416 |
| 334 | 2.922 | 2.5 | 0.5 | −5.69 | −29.71 | 144.61 | 0.422 |
| 335 | 2.928 | 2.5 | 0.5 | −5.49 | −28.56 | 145.96 | 0.428 |
| 336 | 2.933 | 2.5 | 0.5 | −5.28 | −27.41 | 147.31 | 0.433 |
| 337 | 2.939 | 2.5 | 0.5 | −5.08 | −26.26 | 148.66 | 0.439 |
| 338 | 2.944 | 2.5 | 0.5 | −4.87 | −25.11 | 150.02 | 0.444 |
| 339 | 2.949 | 2.5 | 0.5 | −4.66 | −23.97 | 151.37 | 0.449 |
| 340 | 2.953 | 2.5 | 0.5 | −4.45 | −22.82 | 152.73 | 0.453 |
| 341 | 2.958 | 2.5 | 0.5 | −4.24 | −21.68 | 154.09 | 0.458 |
| 342 | 2.962 | 2.5 | 0.5 | −4.02 | −20.53 | 155.45 | 0.462 |
| 343 | 2.966 | 2.5 | 0.5 | −3.81 | −19.39 | 156.81 | 0.466 |
| 344 | 2.970 | 2.5 | 0.5 | −3.59 | −18.24 | 158.17 | 0.470 |
| 345 | 2.974 | 2.5 | 0.5 | −3.37 | −17.10 | 159.53 | 0.474 |

TABLE I-continued

Figure 6:
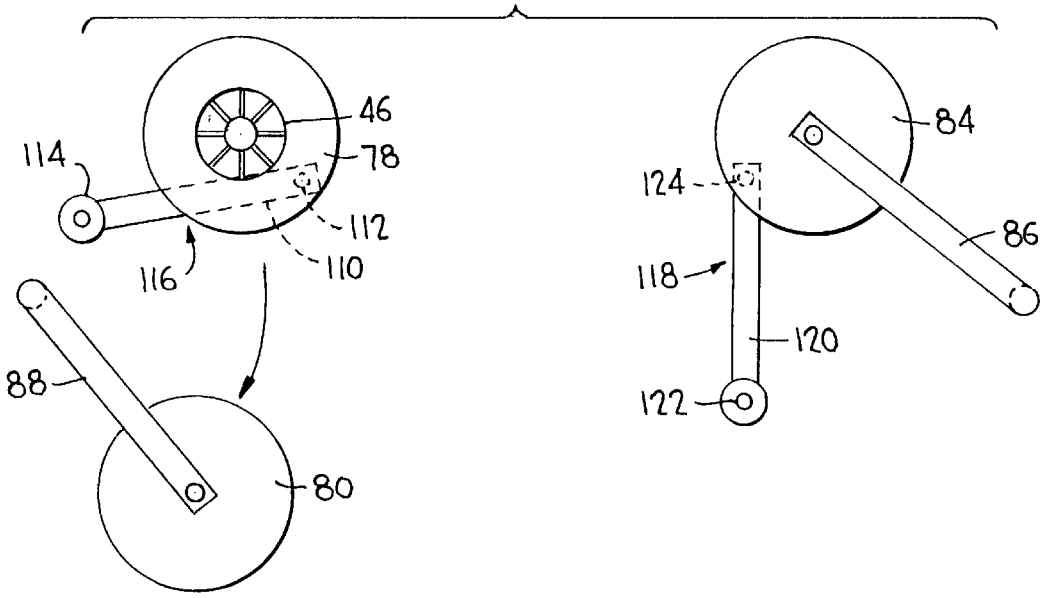
FIGS. 6, 7, 8, 9, 10 and 11 respectively illustrate the movement and operation of the transfer arms in the filamentary material transfer mechanism of the invention for transferring filamentary material from a fully wound mandrel to an unwound mandrel.
Figure 8:
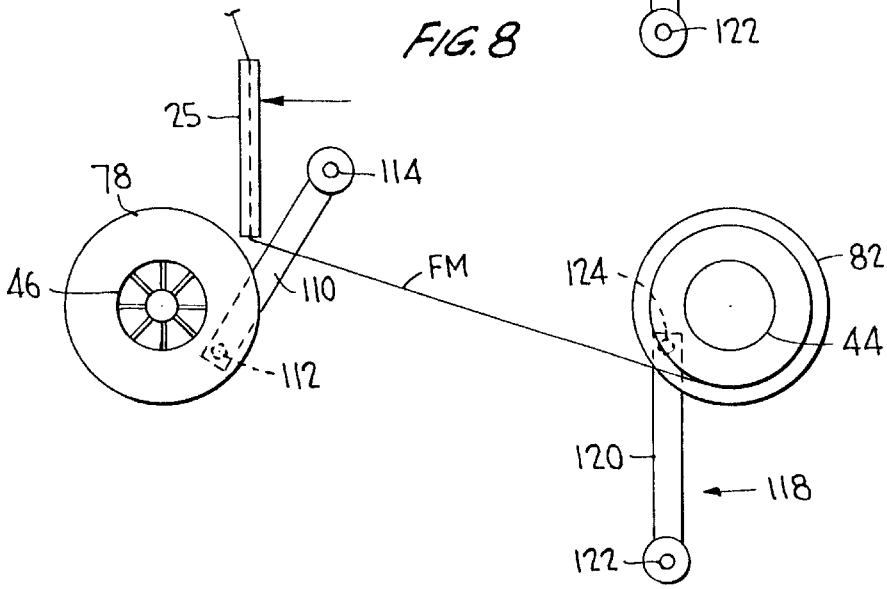
Figure 9:
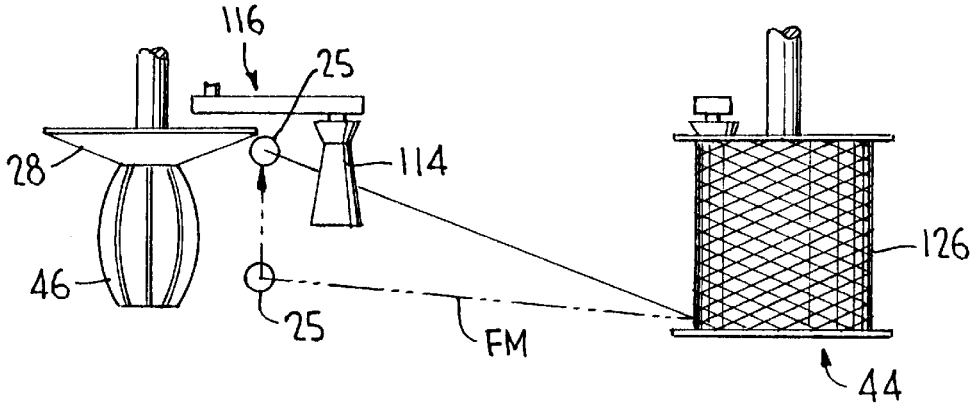

| Input shaft degrees | a, ft | b, ft | c, ft | alpha, degrees | beta, degrees | sigma, degrees | wire guide displacement, ft |
|---|---|---|---|---|---|---|---|
| 346 | 2.977 | 2.5 | 0.5 | −3.15 | −15.96 | 160.89 | 0.477 |
| 347 | 2.980 | 2.5 | 0.5 | −2.93 | −14.82 | 162.25 | 0.480 |
| 348 | 2.983 | 2.5 | 0.5 | −2.71 | −13.68 | 163.61 | 0.483 |
| 349 | 2.986 | 2.5 | 0.5 | −2.49 | −12.54 | 164.98 | 0.486 |
| 350 | 2.988 | 2.5 | 0.5 | −2.26 | −11.39 | 166.34 | 0.488 |
| 351 | 2.990 | 2.5 | 0.5 | −2.04 | −10.25 | 167.71 | 0.490 |
| 352 | 2.992 | 2.5 | 0.5 | −1.82 | −9.11 | 169.07 | 0.492 |
| 353 | 2.994 | 2.5 | 0.5 | −1.59 | −7.97 | 170.44 | 0.494 |
| 354 | 2.996 | 2.5 | 0.5 | −1.36 | −6.83 | 171.80 | 0.496 |
| 355 | 2.997 | 2.5 | 0.5 | −1.14 | −5.70 | 173.17 | 0.497 |
| 356 | 2.998 | 2.5 | 0.5 | −0.91 | −4.56 | 174.53 | 0.498 |
| 357 | 2.999 | 2.5 | 0.5 | −0.68 | −3.42 | 175.90 | 0.499 |
| 358 | 3.000 | 2.5 | 0.5 | −0.46 | −2.28 | 177.27 | 0.500 |
| 359 | 3.000 | 2.5 | 0.5 | −0.23 | −1.14 | 178.63 | 0.500 |
| 360 | 3.000 | 2.5 | 0.5 | 0.00 | 0.00 | 180.00 | 0.500 |
| End of Exec | | | | | | | |

transfer arm being operatively associated with a respective one of the mandrels; (2) controlled movements of the traverse guide assembly and traverse guide itself; and (3) the coordinated removal of the removable endform from the mandrel onto which the FM is to be transferred. The transfer of FM is illustrated with respect to FIGS. 6–11, wherein FIGS. 6–9 and 10 are front views of the mandrels 44 and 46 corresponding to the front view shown in FIG. 1, and FIGS. 9 and 11 are top views of the same mandrels comparable to that of FIG. 2. In the following description it is assumed that the winding on mandrel 44 (the right mandrel in FIGS. 6–11) is completed and it is desired to transfer the FM from that mandrel to the empty mandrel 46 (the mandrel on the left in FIGS. 6–11). With respect to FIG. 6, FM transfer arm 110 is pivotable about pivot point 112 and includes a receiver 114 shaped as shown in FIGS. 9 and 11 for guiding the FM onto the mandrel during the transfer operation. Transfer arm 110 and receiver 114 comprise a transfer assembly 116 that is pivotable about pivot point 112. A similar transfer assembly 118 comprising transfer arm 120 and receiver 122 exists for mandrel 44 (removable endform 84 being shown in FIG. 6) such that the transfer assembly is pivotable about pivot point 124. Prior to transfer of the FM it is necessary to remove the removable endform 80 from mandrel 46 to provide a clear path for the FM as is illustrated in FIG. 6. Transfer assembly 118 is shown in its home or rest position where it remains throughout the transfer process.

Figure 7:
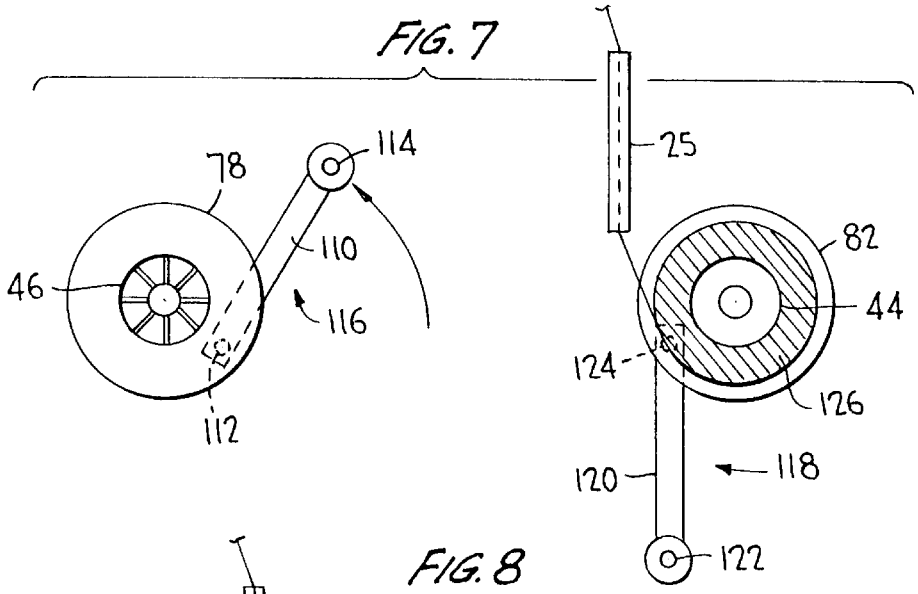

FIG. 7 illustrates the FM being wound onto mandrel 44 from traverse guide 25 and a substantially completed winding 126 of FM on mandrel 44. Transfer assembly 116 is rotated to the semi-upright position shown in FIG. 7. In the next sequence of steps in the transfer process as shown in FIG. 8, the traverse guide assembly including traverse guide 25 is moved from its operative position with respect to mandrel 44 to the left into operative position with respect to mandrel 46. In the next step of the transfer process as illustrated in FIG. 9, the traverse guide 25 is caused to move to its most inward position adjacent the fixed endform 78 of mandrel 46 with removable endform 80 removed as previously described with respect to FIG. 6. The inward movement of traverse guide 25 causes the FM to move from the position shown by the dotted line to the position shown by the solid line, whereby the FM is below receiver 114. The wound coil of FM is shown on mandrel 44 to the right in FIG. 9.

Figure 10:
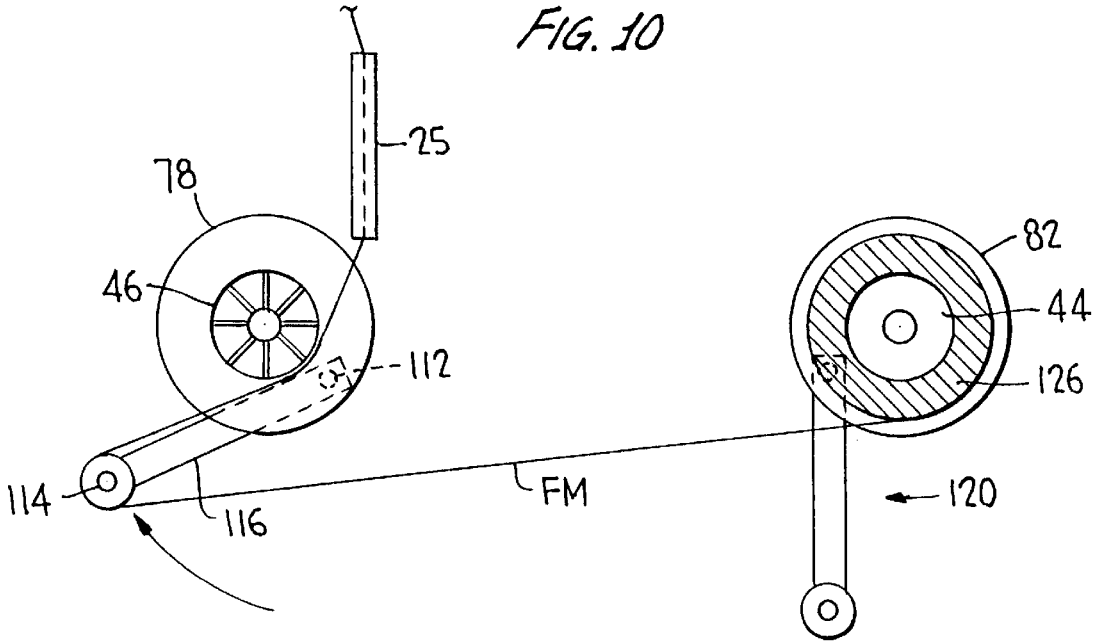
Figure 11:
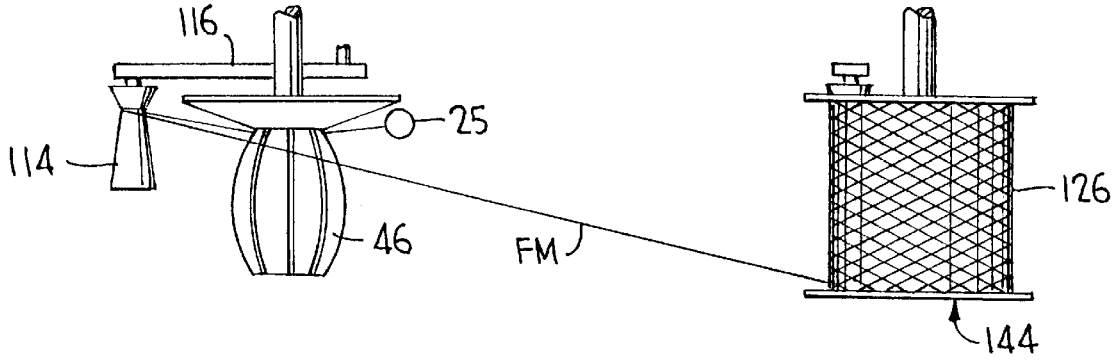

In the next step of the FM transfer process shown in FIG. 10, transfer assembly 116 is rotated clockwise from the position shown in FIGS. 8, 9 thereby causing the FM to be engaged by receiver 114 and further to bring the FM into engagement with the surface of mandrel 46 in a region where the mandrel surface meets with the fixed endform 78. This process is completed in the last stage of the transfer process as shown in FIG. 11, where transfer assembly 116 has completed its clockwise rotation and the FM is fully engaged with the underside surface of the mandrel 46 in the region of a grabber/cutter mechanism (not shown) common to mandrel and fixed endform structure, and known to those skilled in the winding art. The mandrel 46 is prepositioned by the microprocessor control such that the grabber/cutter mechanism is positioned to grab and sever the FM thereby completing the transfer process so that winding may commence with mandrel 46.

Transfer assemblies 116 and 120 are illustrated in FIG. 1, transfer assembly 116 and receiver 114 are also shown in FIG. 4, and transfer assembly 116 and receiver 114 are also shown in FIG. 2. A view of transfer assembly 118 and receiver 122 are shown in FIG. 3, which is similar to the view of FIG. 4 for transfer assembly 116.

Figure 12:
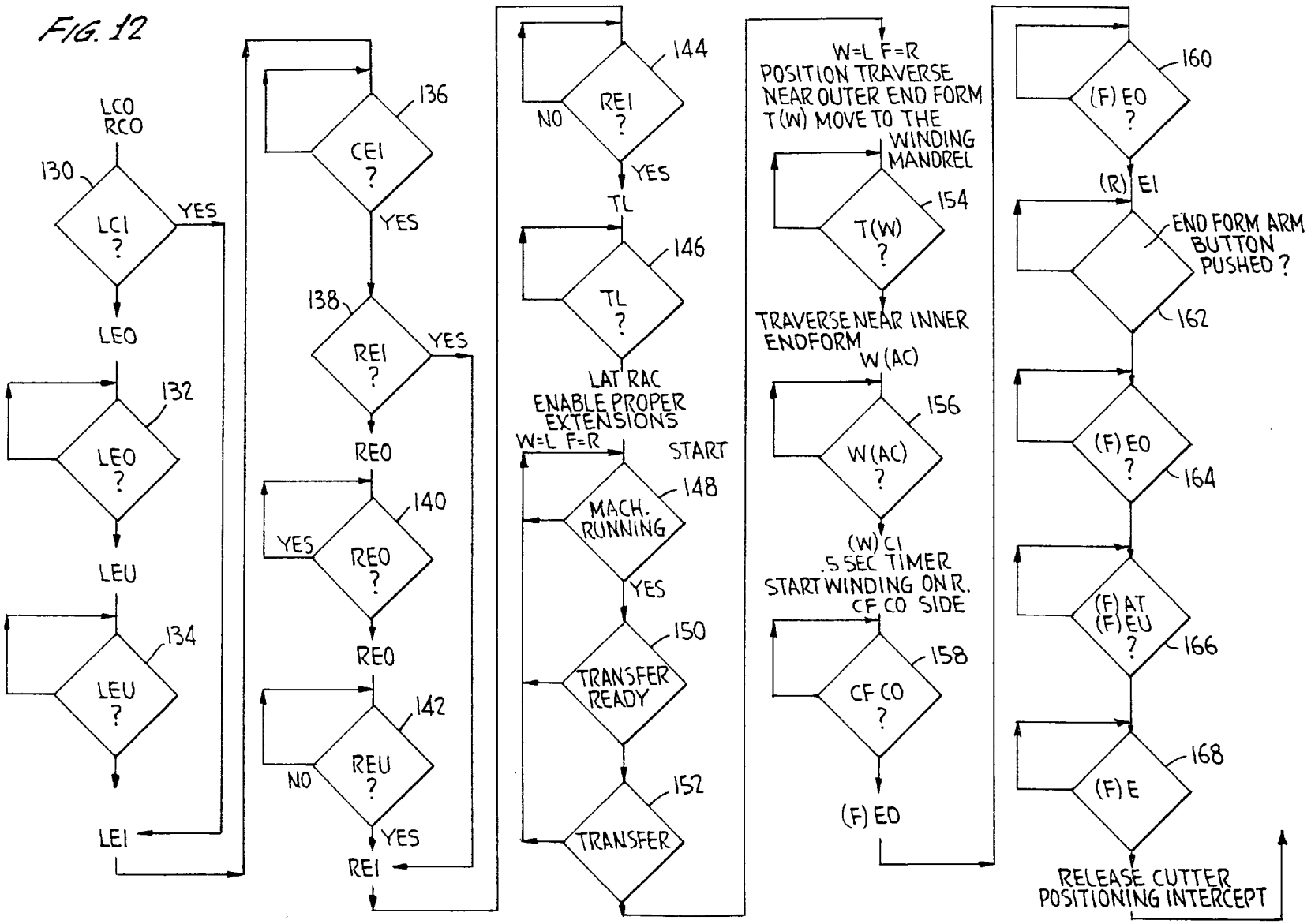
FIG. 12 is a program flow chart illustrating the automatic/manual control of the high speed dual head winding apparatus of the invention.

FIG. 12 illustrates a flow chart representing the steps used in controlling the HSDHWA of the invention. The following is the Table of symbol legends used in the flow chart.

| SYMBOL LEGEND TABLE |
|---|
| ()EI - Endform In Wind position |
| ()EO - Endform Out of Wind position |
| ()AT - Transfer Arm at Traverse |
| ()AC - Transfer Arm at Cut position |
| ()EU - Endform up |
| ()ED - Endform down |
| ()CI - Cutter In cut Position |
| ()CO - Cutter Out of cut position |
| T() - Traverse |
| HIGH SPEED DUAL HEAD ON-LINE WINDING APPARATUS |

N.B.

(1) Replace the space in parenthesis with variable indicating left or right side.

(2) A question mark (?) after the symbols indicates a limit switch or sensor.

With respect to FIG. 12 the program begins with an initialization process wherein the condition or position of the various components of the HSDHWA are determined and set to a necessary position or condition. Thus the program begins with the left and right cutters out of cut position and a determination is made in step 130 whether the left cutter is in the cut position. If the determination is YES, then the program skips to step 136. If the determination in step 130 results in a NO, then the program proceeds to step 132 to determine if the left endform is out of the wind position. If the left endform is out of the wind position, the program reverts to make that determination until a decision is made that the left endform is not out of position, whereby the program proceeds to step 134 to determine the position of the left endform. If the left endform is out of position, the program proceeds to step 136, and if the left endform is not out of position, then the program recycles until there is an indication that the left endform is in the "up" position. With the left endform "up", the program proceeds to step 136 to determine if the left endform is in the wind position. A positive indication in step 136 results in the advancement of the program to step 138 to determine if the right endform is in the wind position. Step 136 is repeated until a determination is made that the left endform is in the wind position. In step 138 if the right endform is in the wind position the program skips to step 144. Step 140 is necessary if the right endform is not in the wind position to determine if the right endform is out of the wind position, and if that is the case, the program recycles to repeat step 140 until a determination is made that the right endform is in the wind position, whereupon the program enters step 142 to determine the status of the right endform. If the determination in step 142 is that the right endform is not "UP", then the program recycles through step 140 until a determination is made by the computer that the right endform is in the "UP" position, whereupon the program proceeds to step 144 to determine if the right endform is in the wind position and a positive indication moves the program to step 146. The program recycles through step 144 if the determination is negative and until a positive indication is given that the right endform is in the proper wind position. The final step in the initialization process for the HSDHWA is to determine in step 146 that the left traverse is in proper position to wind FM on the left mandrel.

It is apparent that the program could be modified so that winding commences on the right mandrel rather than on the left mandrel as described above. It is also apparent to one of ordinary skill in the winding art that the decisions made by the various program steps above described are made in conjunction with sensors positioned at the various components to check their respective status. For the purposes of this invention, the positioning and type of sensors, such as microswitches, do not form a part of the invention as they are well within the ordinary skill of the artisan in the winding art to carry out from the present description defining the functions of such microswitches or other type of sensors. Moreover, the actual program steps will be carried out in a suitably programmed microprocessor to be more fully described hereinafter. However, it is further stated, that for the purposes of the present invention, it is not necessary to provide the computer program operated by the microprocessor as such a program is well within the knowledge of one of ordinary skill in the computer programming art.

The following is a description of the program steps involved in the transfer of FM from one mandrel to another and is taken in conjunction with the previous description of FIGS. 6–11.

Continuing with the program flow chart of FIG. 12, a determination is made in step 148 that the HSDHWA is running and that FM is being wound, and the following program steps are devoted to determining that the HSDHWA is ready to transfer FM from one mandrel to another. Thus, an indication that the HSDHWA is satisfactorily running causes the program to advance to step 150 where a determination is made as to whether the HSDHWA is ready to transfer FM from one mandrel to another, and if a positive indication is given the program advances to program step 152 to actually initiate transfer of the FM. If the transfer is not ready or if the FM has not actually transferred, then the program recycles back to step 148.

The program control beginning with step 154 is the start of the transfer of FM from the right mandrel (the wound mandrel) to the unwound left mandrel, and in step 154 the decision is made as to whether the traverse 25 is winding. The following program steps are taken in conjunction with FIGS. 6–11 and the accompanying description of the transfer process as well as the description of the mandrels 44, 46 and their attendant components taken in conjunction with FIGS. 1–4. If the traverse 25 is not winding the program proceeds to step 156 with the traverse 25 near the inner endform 82 of the right mandrel 44. If the determination in step 154 is that the traverse 25 is winding, then the program recycles until a NO determination is made. In step 156 the determination is made as to whether the transfer arm 110 is at the "cut" position for grabbing and cutting the FM on the unwound left mandrel 46. In between steps 156 and 158 the cutter on the unwound left mandrel 46 is in the "cut" position, and a 5 second interval is allowed to elapse for the cutting operation to take place and the program to proceed to step 158 where winding of FM is to proceed on the left mandrel 46 if the cutter mechanism is out of the "cut" position, thereby enabling FM to be wound on the left mandrel 46. If the cutter mechanism is not out of the "cut" position, then the program recycles at step 158 until such detection is made. With the cutter out of the "cut" position the program proceeds to step 160 where a determination is made as to whether the endform is out of the wind position, and if it is the program recycles at step 160 until an indication is received that is not and the operator has depressed the "endform arm button" at step 162 at the work station indicating that the coil has been removed from the mandrel. At program step 164 a determination is made as to the status of the endform, namely is it out of the wind position. If it is, the program recycles at step 164 until the detection is made that it is not, whereupon the program proceeds to step 166 to determine: (1) whether the transfer arm is at the traverse position; and (2) whether the endform is "up". If both these conditions are positive, then the program proceeds to step 168 to determine whether the endform is in the wind position so that winding may commence on the left mandrel 46.

Figure 13A:
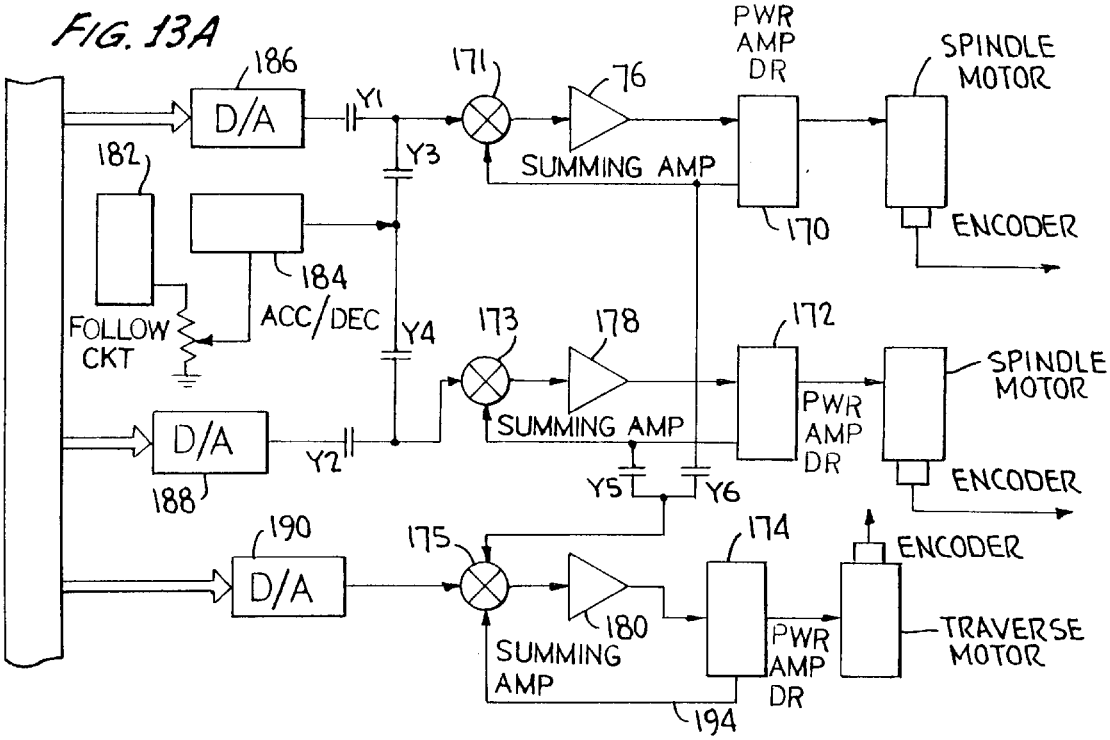
FIGS. 13, 13*b* and 13*c* are schematic block diagrams of the microprocessor-based control circuitry for the HSDHWA.
Figure 13C:
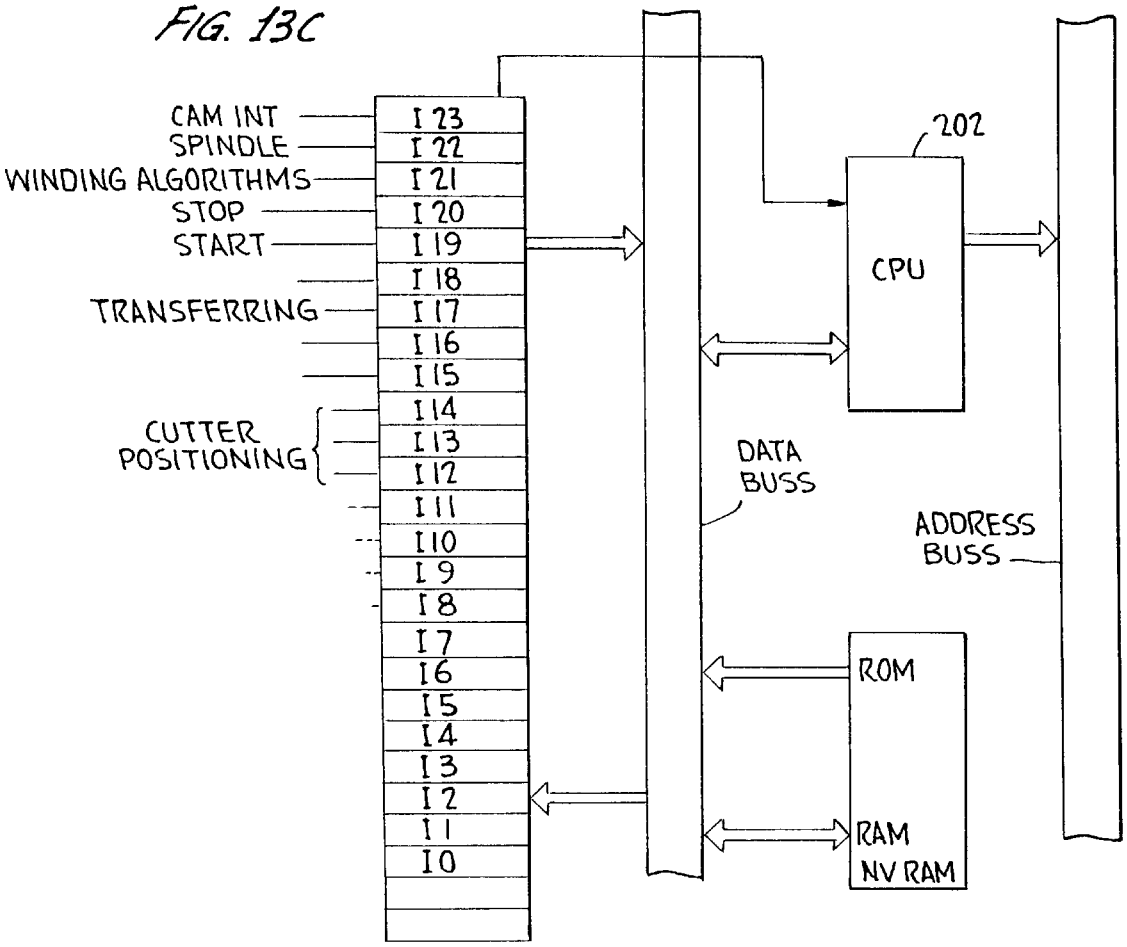
Figure 13B:
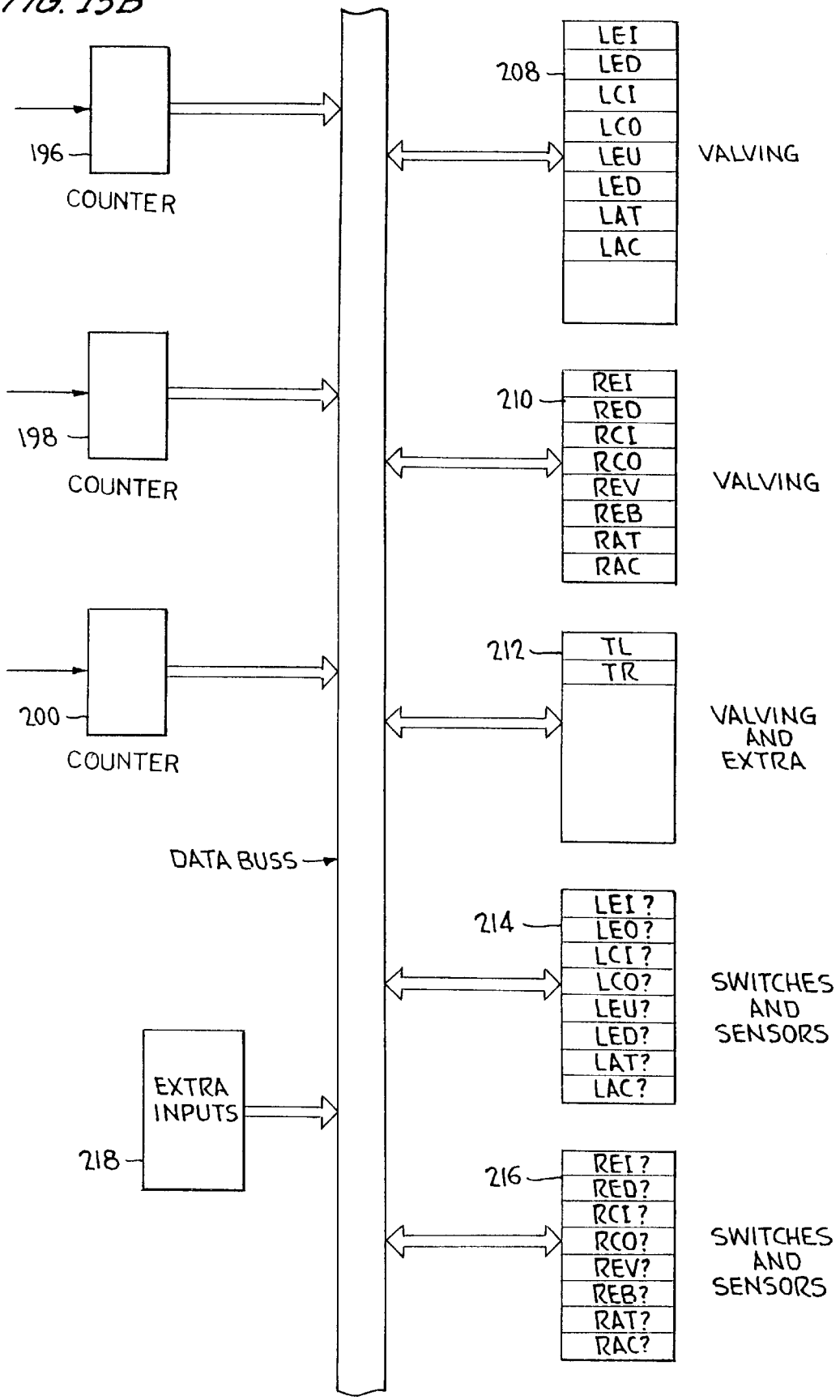

The following is a description of the control block diagram of FIGS. 13A–13C. Prior to such description it is noted that the spindle motors and the traverse motor (shown in FIGS. 1–4) each have respective sensors to provide data as to the relative spindle shaft positions and the position of the traverse. These components are depicted in FIG. 13A. The respective power amplifier drivers 170, 172 and 174 provide motor speed data back to respective summing amplifiers 176, 178 and 180 through summators 171, 173 and 175 to regulate the speed and (and ultimately the relative position) of the traverse relative to the mandrel that is winding, to produce, for example a "FIG. 8" coil with a radial payout hole, for example as defined in U.S. Pat. No. 4,406,419 owned by the same assignee as the present invention.

If the HSDHWA were used in conjunction with an extruder line for making wire or wire cable, a follower circuit 182 provides a master speed reference for the HSDHWA. Since the extruder (not shown) provides FM at a constant feet per minute, the RPM of the winding spindle must decrease as the coil diameter increases. The acceleration/deceleration circuit 184 provides the proper "speed ramping" signal so that the HSDHWA does not accelerate too quickly to cause a break in the FM, or conversely, decelerate so rapidly that the FM becomes so slack that problems such as the FM lifting-off of the sheaves in the input feed assembly 22 of FIGS. 1–4. Digital/Analog (D/A) converters 186, 188 convert analog data from data buss 192 relating to other functions, for example such as the positioning of the grabber/cutter mechanism on each mandrel, to respective relays Y1, Y2, and the output from D/A converter 190 is input directly to summator 175. Relays Y1, Y2, Y3, Y4, Y5 and Y6 determine how the converted signals from the data buss 192 are routed. For example, if mandrel 44 (FIGS. 1–4) and mandrel 46 are waiting for transfer of FM, the following conditions of the relays would exist: relay Y1 open; relay Y2 closed; relay Y3 closed; relay Y4 open; relay Y5 open and relay Y6 closed. These relays are under the direct control of the computer.

Power amplifier 174 and summing amplifier 180 with the motor feedback 194 regulate the speed of the traverse. D/A converter 190 provides the final adjustment to the speed of the traverse that ultimately determines the position of the traverse to produce the wound coil on a mandrel. Since this system is of the master/follower type, relays Y5 and Y6 determine which mandrel provides the speed reference to the traverse mechanism.

With reference to FIG. 13B, the up/down counters 196, 198 and 200 provide the central processing unit CPU 202 of microprocessor 204 (FIG. 13C) with information concerning the position of the mandrels and the traverse mechanism. Up/down counters 196, 198 and 200 provide information defining the relative position of each spindle shaft/motor as the case may be. The absolute position of these components, which must be known to accurately position the cutters, is determined with the use of a sensor on each spindle shaft and on the traverse mechanism as described above with respect to FIG. 1–4. The spindle shaft and traverse mechanism sensors are used to interrupt the CPU 202. Whenever one of these interrupts occurs, a subroutine in the CPU is run that reads the appropriate one of counters 196, 198 and 200. This number is saved and used in a Winding Algorithm (for example see U.S. Pat. No. 4,406,419, noted elsewhere herein) and Cutter Positioning routine as an offset. For example, if when the interrupt occurs, a particular one of counters 196, 198 and 200 reads "77" this number is subtracted from all other read outs of that particular counter. If next time the CPU 202 reads the same counter (for the winding Algorithm for example), the count is "78", then "78−77"=1. This represents the absolute position of the shaft, for example, that is associated with the particular counter being read. In other words, the sensor and interrupt system just described locates the ZERO position of each shaft/traverse. These interrupts are of high priority and are located in the priority scheme at the top of interrupt block 204 FIG. 13*c* and are identified therein as interrupts I23 (traverse), I22 (left spindle) and I21 (right spindle).

A hardware prioritized interrupt scheme is used to control the operation of the HSDHWA. Each interrupt has an associated subroutine that is run when the interrupt occurs. These interrupts include shaft sensors, Winding Algorithms, machine STOP, START, Manual transfer, Length counter and Length Reset. The interrupt scheme also includes a routine that is called at 10 Hz when it is time to position the cutter for transfer of the FM and a "Heart Beat" routine that indicates that the CPU 202 is functioning and that it is "scanning" I/O ports for faults. Many other interrupts may be programmed to meet particular customer requirements.

Valving of air for the various pneumatic cylinders, for example for moving the traverse mechanism platform 52 as described above with respect to FIGS. 1–4, is controlled through ports 208, 210 and 212. It is noted that the CPU 202 generally follows the program described above with respect to FIG. 12. The various switches and sensors described above with respect to FIGS. 1–4 and other customer inputs are sensed with the input ports 214, 216 and 218.

A keypad 220 is used to for the entry and storage of variables such as Upper Ratio, Lower Ratio, Hole Size, Hole Bias, Coil Length, etc., into the RAM 222 and NVRAM 224 of microprocessor 204.

A four digit display 226 is used to display coil length and other inputed data from the keypad 220.

A control panel may be provided for the operator and which is mounted on the frame of the HSDHWA at a position that is convenient for the operator in the vicinity of the front of the HSDEWA near the mandrels 44 and 46. The control panel includes at least five control switches, which provide control over the respective exemplary functions of STOP, EMERGENCY STOP, ENDFORM UP/DOWN, INPUT ACCUMULATOR UP/DOWN and TRANSFER BAD WIRE. These switches are either center ON/OFF or pushbutton switches as the control conditions dictate. The functions performed by each of these control switches are believed to be evident from their name taken in conjunction with the description herein of the structure and operation of the HSDHWA.

It is submitted that one of ordinary skill in the winding and computer art to which the present invention is directed would have sufficient knowledge concerning the operation of electrical motors, pneumatic valves, sensors, etc., and to utilize such components that the invention may be carried out without providing a detailed schematic of the electrical wiring, pneumatic tubing and the electrical interconnections between the various components of the HSDHWA described herein.

It is noted that none of the Figures illustrate a component for rotation of the endform transfer arms. Such component was not illustrated to avoid cluttering the drawings. However, it is believed apparent to one of ordinary skill in the winding art, that such rotation may be effected, for example by a suitable motor geared or belted to the endform shaft, by a cable system, etc., and controlled by a suitable signal from the microprocessor described herein.

It is further submitted that one of ordinary skill in the winding art to which the invention is directed would recognize the equivalence between pneumatically driven solenoids, electrically driven solenoids, cable systems and other devices for providing the power to move the various carriages and platforms described herein, so that where the description herein mentions, for example a pneumatic actuator, the equivalent components could be substituted in their place without affecting the operation of the HSDHWA herein described.

What is claimed is:

1. High speed traversing mechanism for winding filamentary material onto a rotating mandrel, comprising:

an indexer means including a crank arm rotatable about a pivot point;

a connecting rod connected to said crank arm at a second pivot point;

a traverse guide connected to said connecting rod at a third pivot point located on the center line of said traverse guide and said traverse guide reciprocating within a support with rotation of said crank arm;

said pivot point is positioned at a point on said center line spaced from said third pivot point;

said connecting rod forming a given angle with said center line;

said indexer means rotating said rotatable crank arm to displace said traverse guide along said center line within said support; and means for controlling said indexer means to wind said filamentary material onto mandrel.

2. A high speed traversing mechanism according to claim 1, wherein said crank arm forms an angle beta with respect to said center line; said connecting rod forms an angle sigma with respect to said crank arm; said connecting rod forming an angle alpha with said center line; and said means for controlling the displacement of said traverse guide in said support as a function of the rotation of said crank arm from the input shaft degrees (rotation of the crank arm), alpha, beta and sigma values set forth in Table I and wherein the length of said crank arm is one-half foot, the length of said connecting rod is 2.5 feet and the resulting displacement of the wire guide is indicated by the wire guide displacement of Table I.

3. Winding apparatus for consecutively winding filamentary material (FM) on respective first and second mandrels, comprising:

first and second independently operable spindles mounted for rotation about respective parallel-spaced axes located in a horizontal plane of a winding apparatus frame;

said first and second mandrels removably mounted respectively on each of said first and second spindles;

a traverse mechanism mounted to said apparatus frame for movement between said parallel-spaced axes for reciprocating movement along an axis parallel to, and spaced from, said parallel-spaced axes;

said traverse mechanism comprising:

an indexer means including a crank arm rotatable about a pivot;

a connecting rod connected to said crank arm at a second pivot point;

a traverse guide connected to said connecting rod at a third pivot point located on the center line of said traverse guide and said traverse guide reciprocating within a support with rotation of said crank arm;

said pivot point is positioned at a point on said center line spaced from said third pivot point;

said connecting rod forming a given angle with said center line;

said indexer means rotating said rotatable crank arm to displace said traverse guide along said center line within said support;

means for independently rotating each of said first and second spindles;

means for moving said traverse guide in cooperation with said means for independently rotating to consecutively wind FM on said first and second mandrels;

transfer means movably mounted to said apparatus frame for guiding FM from at least one of said first and second mandrel each having FM wound thereon to at least one of said second and first empty mandrel; and further including, for each said first and second mandrels, a transfer arm pivotable about a pivot point adjacent the respective mandrel for guiding the FM onto a respective one of said first and second mandrels during transfer of said FM from a mandrel having FM wound thereon to an empty mandrel; and means for controlling said means for independently rotating, said means for reciprocating and said transfer means for moving said traverse guide adjacent at least one of said first empty and second empty mandrel in coordination with rotation of that transfer arm associated with the mandrel to which FM is to be transferred for winding FM onto an empty mandrel.

4. Winding apparatus according to claim 3 wherein said crank arm forms an angle beta with respect to said center line; said connecting rod forms an angle sigma with respect to said crank arm; said connecting rod forming an angle alpha with said center line; and said means for controlling the displacement of said traverse guide in said support as a function of the rotation of said crank arm from the input shaft degrees (rotation of the crank arm), alpha, beta and sigma values set forth in Table I and wherein the length of said crank arm is one-half foot, the length of said connecting rod is 2.5 feet and the resulting displacement of the wire guide is indicated by the wire guide displacement of Table I.

5. Winding apparatus according to claim 3, further comprising a platform for mounting said traverse mechanism for said movement thereof.

6. Winding apparatus according to claim 3, further comprising a frame support for mounting said traverse mechanism and said first and second spindles on the front of said frame; and input feeding means for substantially continuously feeding FM from a source of supply thereof located to the rear of said frame support to said traverse mechanism and including a spring-loaded input accumulator mounted on top of said frame support and receiving said FM from said source of supply.

7. Winding apparatus according to claim 6, wherein said input feeding means further includes means for lowering said input accumulator from an operating position to a position enabling an operator to have access to said accumulator for stringing FM therein.

8. High speed traversing method for winding FM onto a mandrel in a winding apparatus, comprising:

an indexer means including a crank arm rotatable about a pivot;

a connecting rod connected to said crank arm at a second pivot point;

a traverse guide connected to said connecting rod at a third pivot point located on the center line of said traverse guide and said traverse guide reciprocating within a support with rotation of said crank arm;

said pivot point is positioned at a point on said center line spaced from said third pivot point;

said connecting rod forming a given angle with said center line;

said method comprising the steps of:

rotating said rotatable crank arm by movement of said indexer means to displace said traverse guide along said center line within said support; and controlling said indexer means to wind said FM onto said mandrel.

9. A high speed traversing method according to claim 8, wherein said crank arm forms an angle beta with respect to said center line; said connecting rod forms an angle sigma with respect to said crank arm; said connecting rod forming an angle alpha with said center line; and further comprising the step of controlling the displacement of said traverse guide in said support as a function of the rotation of said crank arm from the input shaft degrees (rotation of the crank arm), alpha, beta and sigma values set forth in Table I and wherein the length of said crank arm is one-half foot, the length of said connecting rod is 2.5 feet and the resulting displacement of the wire guide is indicated by the wire guide displacement of Table I.

10. A winding method according to claim 9, further comprising the step of:

controlling the displacement of said traverse guide in said support as a function of the rotation of said crank arm from the input shaft degrees (rotation of the crank arm), alpha, beta and sigma values set forth in Table I and wherein the length of said crank arm is one-half foot, the length of said connecting rod is 2.5 feet and the resulting displacement of the wire guide is indicated by the wire guide displacement of Table I.

11. A winding method according to claim 9, further comprising the step of mounting said traverse mechanism and first and second spindles on the front of a frame; and substantially continuously feeding FM from a source of supply thereof located to the rear of said frame support to said traverse mechanism and including a spring-loaded input accumulator mounted on top of said frame support and receiving said FM from said source of supply.

12. A winding method according to claim 11, further comprising the step of lowering said input accumulator from an operating position to a position enabling an operator to have access to said accumulator for stringing FM therein.

13. A winding method for consecutively winding FM on respective first and second mandrels in a winding apparatus, comprising:

first and second independently operable spindles mounted for rotation about respective parallel-spaced axes located in a horizontal plane of a winding apparatus frame;

said first and second mandrels removably mounted respectively on each of said first and second spindles;

a traverse mechanism mounted to said apparatus frame for movement between said parallel-spaced axes for reciprocating movement along an axis parallel to, and spaced from, said parallel-spaced axes;

said traverse mechanism comprising:

an indexer means including a crank arm rotatable about a pivot;

a connecting rod connected to said crank arm at a second pivot point;

a traverse guide connected to said connecting rod at a third pivot point located on the center line of said traverse guide and said traverse guide reciprocating within a support with rotation of said crank arm;

said pivot point is positioned at a point on said center line spaced from said third pivot point;

said connecting rod forming a given angle with said center line; said method comprising the steps of:

rotating said rotatable crank arm by movement of said indexer means to displace said traverse guide along said center line within said support;

independently rotating each of said first and second spindles;

moving said traverse guide in cooperation with said means for independently rotating to consecutively wind FM on said first and second mandrels; and said winding apparatus further comprising:

transfer means movably mounted to said apparatus frame for guiding FM from at least one of a first and second mandrel each having FM wound thereon to at least one of a second and first empty mandrel; and further including, for each said first and second mandrels, a transfer arm pivotable about a pivot point adjacent the respective mandrel for guiding the FM onto a respective one of said first and second mandrels during transfer of said FM from a mandrel having FM wound thereon to an empty mandrel; and said method of winding further comprising the steps of:

controlling said means for independently rotating, said means for reciprocating and said transfer means for moving said traverse guide adjacent at least one of said first empty and second empty mandrel in coordination with rotation of that transfer arm associated with the mandrel to which FM is to be transferred for winding onto an empty mandrel.

* * * * *